US011267629B2

(12) United States Patent
Yang

(10) Patent No.: US 11,267,629 B2
(45) Date of Patent: Mar. 8, 2022

(54) STORAGE BAG WITH EASY FLIPPING FEATURE

(71) Applicant: Universal Trim Supply Co., Ltd., New Taipei (TW)

(72) Inventor: Shih-Sheng Yang, Taipei (TW)

(73) Assignee: Universal Trim Supply Co., Ltd., New Taipei (TW)

( * ) Notice: Subject to any disclaimer, the term of this patent is extended or adjusted under 35 U.S.C. 154(b) by 0 days.

(21) Appl. No.: 16/919,121

(22) Filed: Jul. 2, 2020

(65) Prior Publication Data

US 2022/0002055 A1 Jan. 6, 2022

(51) Int. Cl.

| | |
|---|---|
| ***B65D 75/52*** | (2006.01) |
| ***B65D 75/00*** | (2006.01) |
| ***B65D 33/25*** | (2006.01) |
| ***B65D 30/24*** | (2006.01) |
| ***B65D 30/08*** | (2006.01) |

(52) U.S. Cl.

CPC ..... *B65D 75/52* (2013.01); *B65D 31/02* (2013.01); *B65D 31/147* (2013.01); *B65D 33/25* (2013.01); *B65D 75/008* (2013.01)

(58) Field of Classification Search

CPC ..... B65D 75/52; B65D 31/02; B65D 31/147; B65D 33/25; B65D 75/008

USPC ..... 383/2, 4, 104, 121, 22–24, 26–28

See application file for complete search history.

(56) References Cited

U.S. PATENT DOCUMENTS 2,060,238 A * 11/1936 Mial ..... D06F 43/00 383/71
2,164,641 A * 7/1939 Davenport ..... A45C 7/0077 383/127
2,716,558 A * 8/1955 Annak ..... A45C 5/143 280/651
3,838,758 A * 10/1974 Brown ..... B65D 29/00 383/38
3,850,467 A * 11/1974 Johnson ..... E01H 1/1206 294/1.3
4,232,808 A * 11/1980 Gray ..... A45C 11/38 224/610
4,768,818 A * 9/1988 Kolic ..... A01K 23/005 294/1.3
4,782,874 A * 11/1988 Chartier ..... A45C 7/0077 150/112
5,643,189 A * 7/1997 Masini ..... A61F 13/00038 206/440
5,800,061 A * 9/1998 Voiles ..... A45C 3/00 150/103
5,806,668 A * 9/1998 Bixby ..... A41D 19/0068 15/227
9,957,677 B2 * 5/2018 Johnson ..... E01H 1/1206

(Continued)

*Primary Examiner* — Jes F Pascua

(74) *Attorney, Agent, or Firm* — Winston Hsu

(57) ABSTRACT

A storage bag includes a bag body and a first operating component. The bag body includes a top portion and a bottom portion opposite to the top portion. An opening is formed on the top portion. The first operating component is connected to an inner side of the bottom portion. The first operating component is pulled through the opening for flipping the bag body inside out. The present invention allows a user to flip the bag body inside out by pulling the first operating component through the opening, which makes it easy to clean the interior of the bag body thoroughly.

27 Claims, 26 Drawing Sheets

(56) References Cited

U.S. PATENT DOCUMENTS

| | | | | |
|---|---|---|---|---|
| 2015/0266624 | A1* | 9/2015 | Clodfelter | B65F 1/0006 383/10 |
| 2020/0071067 | A1* | 3/2020 | Pabon Pernia | B65D 88/54 |

* cited by examiner

STORAGE BAG WITH EASY FLIPPING FEATURE

BACKGROUND OF THE INVENTION

1. Field of the Invention

The present invention relates to a bag, and more specifically, to a storage bag with easy flipping feature.

2. Description of the Prior Art

With advancement of technology and development of economy, there are more and more consumer goods available in the market. For example, a storage product, such as a storage bag, for food storage is one of the consumer goods. When it is desired to reuse the storage bag, cleanliness of the storage bag is required. However, the conventional storage bag is not easy to be cleaned because there is limited access to the interior of the conventional storage bag.

SUMMARY OF THE INVENTION

Therefore, it is an objective to provide a storage bag with easy flipping feature for solving the aforementioned problem.

In order to achieve the aforementioned objective, the present invention discloses a storage bag with easy flipping feature. The storage bag includes a bag body and a first operating component. The bag body includes a top portion and a bottom portion opposite to the top portion. An opening is formed on the top portion. The first operating component is connected to an inner side of the bottom portion. The first operating component is pulled through the opening for flipping the bag body inside out.

According to an embodiment of the present invention, the bag body includes a first layer, a second layer and a bottom layer. Two lateral portions of the first layer are respectively connected to two lateral portions of the second layer. A bottom layer is connected to a bottom portion of the first layer and a bottom portion of the second layer, and the bottom portion of the bag body is wider than the top portion of the bag body along a wide direction.

According to an embodiment of the present invention, two end portions of the first operating component are arranged along the wide direction and connected to the bottom layer. A middle portion of the first operating component between the two end portions of the first operating component is separated from the bottom layer, and an operating space is formed between the middle portion of the first operating component and the bottom layer.

According to an embodiment of the present invention, two end portions of the first operating component are arranged along a longitudinal direction perpendicular to the wide direction and connected to the bottom layer. A middle portion of the first operating component between the two end portions of the first operating component is separated from the bottom layer, and an operating space is formed between the middle portion of the first operating component and the bottom layer.

According to an embodiment of the present invention, a top portion of the first layer is connected to a top portion of the second layer, and the opening is formed on the top portion of the first layer.

According to an embodiment of the present invention, the opening is formed between a top portion of the first layer and a top portion of the second layer.

According to an embodiment of the present invention, the bag body includes a first layer and a second layer. Two lateral portions of the first layer are respectively connected to two lateral portions of the second layer. A bottom portion of the first layer is connected to a bottom portion of the second layer, and a portion of the first operating component is located between and connected to the bottom portion of the first layer and the bottom portion of the second layer.

According to an embodiment of the present invention, an operating space is formed on an operating end of the first operating component away from a connecting end of the first operating component connected to the bottom portion of the first layer and the bottom portion of the second layer.

According to an embodiment of the present invention, two end portions of the first operating component are arranged along a longitudinal direction and connected to the bottom portion of the first layer and the bottom portion of the second layer. A middle portion of the first operating component between the two end portions of the first operating component is separated from the bottom portion of the first layer and the bottom portion of the second layer, and an operating space is formed between the middle portion of the first operating component and the bottom portion of the bag body.

According to an embodiment of the present invention, a top portion of the first layer is connected to a top portion of the second layer, and the opening is formed on the top portion of the first layer.

According to an embodiment of the present invention, the opening is formed between a top portion of the first layer and a top portion of the second layer.

According to an embodiment of the present invention, the storage bag further includes a sealing system for sealing the opening.

According to an embodiment of the present invention, the storage bag further includes a vacuum system for discharging a fluid inside the bag body.

According to an embodiment of the present invention, the storage bag further includes a second operating component connected to an outer side of the bottom portion opposite to the inner side of the bottom portion.

In summary, since the storage bag of the present invention includes the first operating component connected to the inner side of the bottom portion of the bag body, the present invention allows a user to flip the bag body inside out by pulling the first operating component through the opening, which makes it easy to clean the interior of the bag body thoroughly.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, the term "couple" is intended to mean either an indirect or direct electrical/mechanical connection. Thus, if a first device is coupled to a second device, that connection may be through a direct electrical/mechanical connection, or through an indirect electrical/mechanical connection via other devices and connections.

Figure 1:
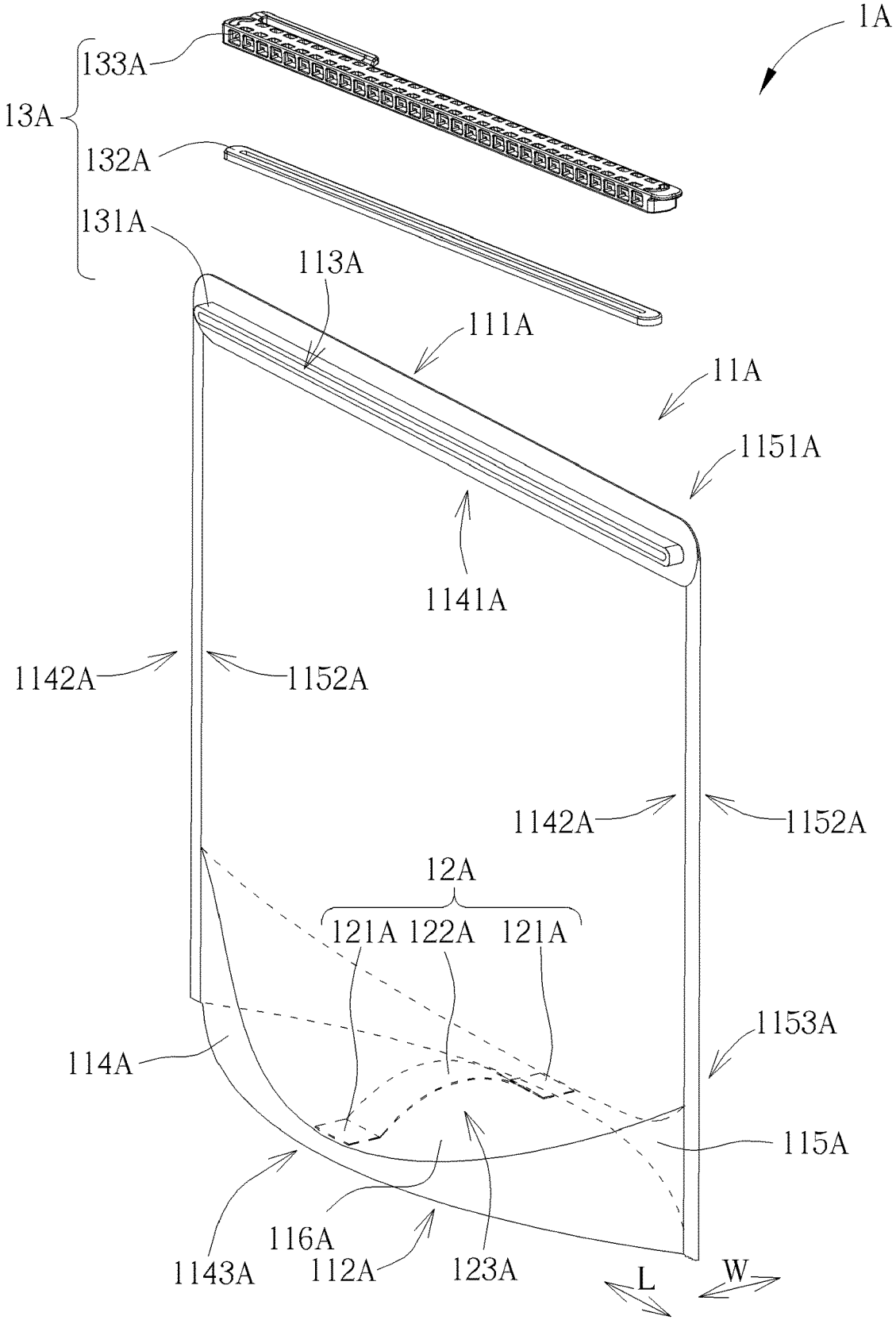
FIG. 1 is an exploded diagram of a storage bag according to a first embodiment of the present invention.
Figure 2:
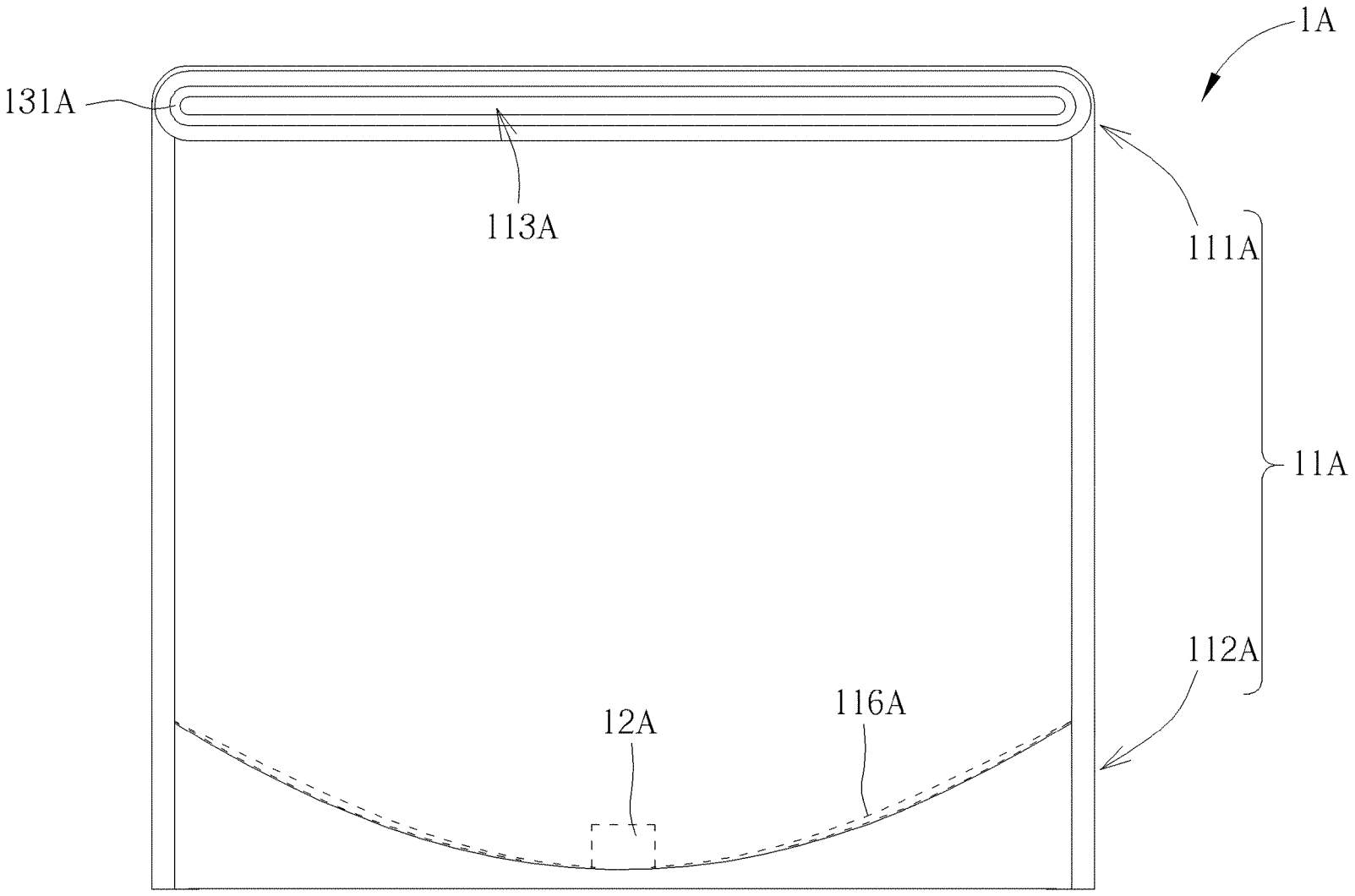
FIG. 2 is a partial diagram of the storage bag according to the first embodiment of the present invention.
Figure 3:
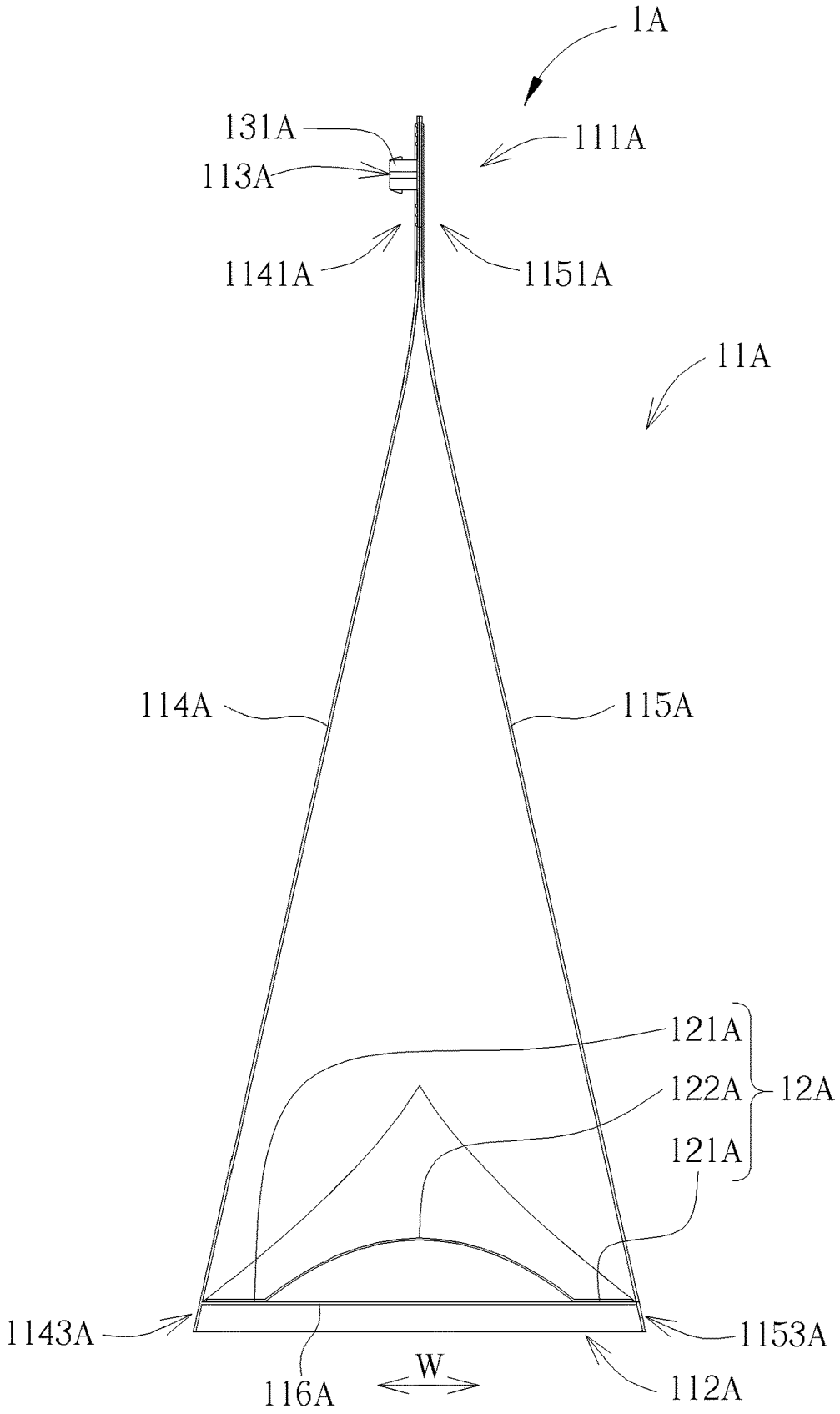
FIG. 3 is a partial sectional diagram of the storage bag according to the first embodiment of the present invention.

Please refer to FIG. 1 to FIG. 3. FIG. 1 is an exploded diagram of a storage bag 1A according to a first embodiment of the present invention. FIG. 2 is a partial diagram of the storage bag 1A according to the first embodiment of the present invention. FIG. 3 is a partial sectional diagram of the storage bag 1A according to the first embodiment of the present invention. As shown in FIG. 1 to FIG. 3, the storage bag 1A includes a bag body 11A, a first operating component 12A and a sealing system 13A. The bag body 11A includes a top portion 111A and a bottom portion 112A opposite to the top portion 111A. An opening 113A is formed on the top portion 111A. The first operating component 12A is connected to an inner side of the bottom portion 112A. The first operating component 12A can be pulled through the opening 113A by a user for flipping the bag body 11A inside out. The sealing system 13A is for sealing the opening 113A.

In this embodiment, the sealing system 13A includes a protruding portion 131A, a sealing component 132A and a cover 133A. The protruding portion 131A is disposed on the top portion 111A of the bag body 11A. The opening 113A penetrates through the protruding portion 131A. The sealing component 132A is disposed on the cover 133A. The cover 133A can be installed on or detachable from the protruding portion 131A. When the cover 133A is installed on the protruding portion 131A, the protruding portion 131A can be squeezed by the cover 133A and the sealing component 132A to seal the opening 113A. However, the sealing system of the present invention is not limited to this embodiment. For example, in another embodiment, the sealing component can include a zipper, which includes a male member and a female member, with or without a slider.

Specifically, the bag body 11A includes a first layer 114A, a second layer 115A and a bottom layer 116A. The first layer 114*a*, the second layer 115A and the bottom layer 116A can be made of plastic material, such as Polypropylene (PP), Polyethylene (PE), Polyvinyl chloride (PVC), or Thermoplastic polyurethanes (TPU), or silicone rubber. However, the present invention is not limited thereto. A top portion 1141A of the first layer 114A is connected to a top portion 1151A of the second layer 115A. The opening 113A is formed on the top portion 1141A of the first layer 114A. Two lateral portions 1142A of the first layer 114A are respectively connected to two lateral portions 1152A of the second layer 115A. The bottom layer 116A is connected to a bottom portion 1143A of the first layer 114A and a bottom portion 1153A of the second layer 115A. The top portion 1141A of the first layer 114A and the top portion 1151A of the second layer 115A cooperatively form the top portion 111A of the bag body 11A. The bottom layer 116A, the bottom portion 1143A of the first layer 114A and the bottom portion 1153A of the second layer 115A cooperatively form the bottom portion 112A of the bag body 11A. The bottom portion 112A of the bag body 11A can be wider than the top portion 111A of the bag body 11A along a wide direction W, such that a wide bottom accommodating space is formed inside the bag body 11A for storage.

Furthermore, two end portions 121A of the first operating component 12A are arranged along the wide direction W and connected to the bottom layer 116A. A middle portion 122A of the first operating component 12A between the two end portions 121A of the first operating component 12A is separated from the bottom layer 116A, and an operating space 123A is formed between the middle portion 122A of the first operating component 12A and the bottom layer 116A.

When it is desired to flip the bag body 11A inside out, a user can insert his/her hand into the bag body 11A through the opening 113A and stretch his/her finger through the operating space 123A to pull the first operating component 12A upwardly, so as to flip the bag body 11A inside out, which makes it easy to clean the interior of the bag body 11A thoroughly.

Figure 4:
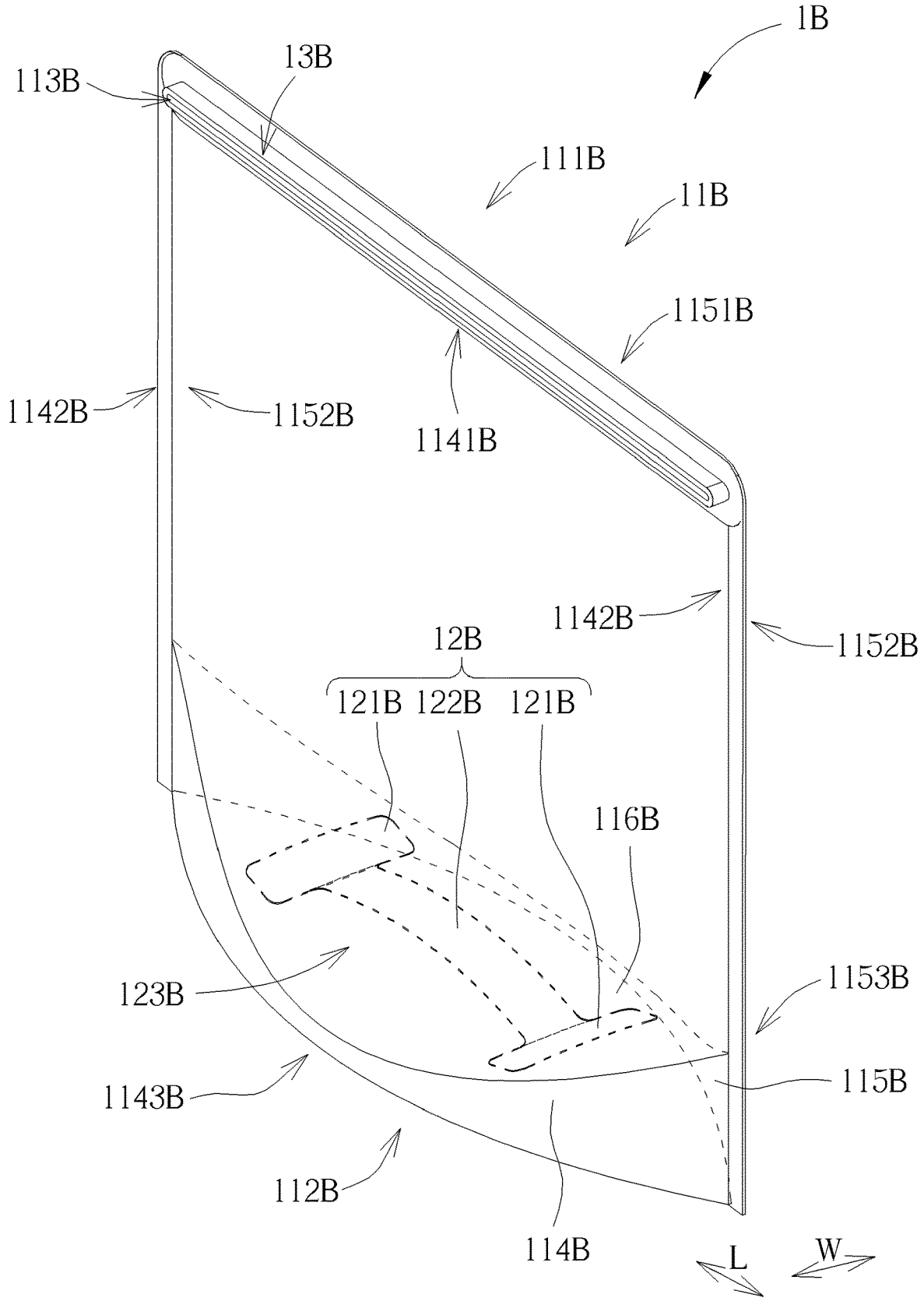
FIG. 4 is a partial perspective diagram of a storage bag according to a second embodiment of the present invention.
Figure 5:
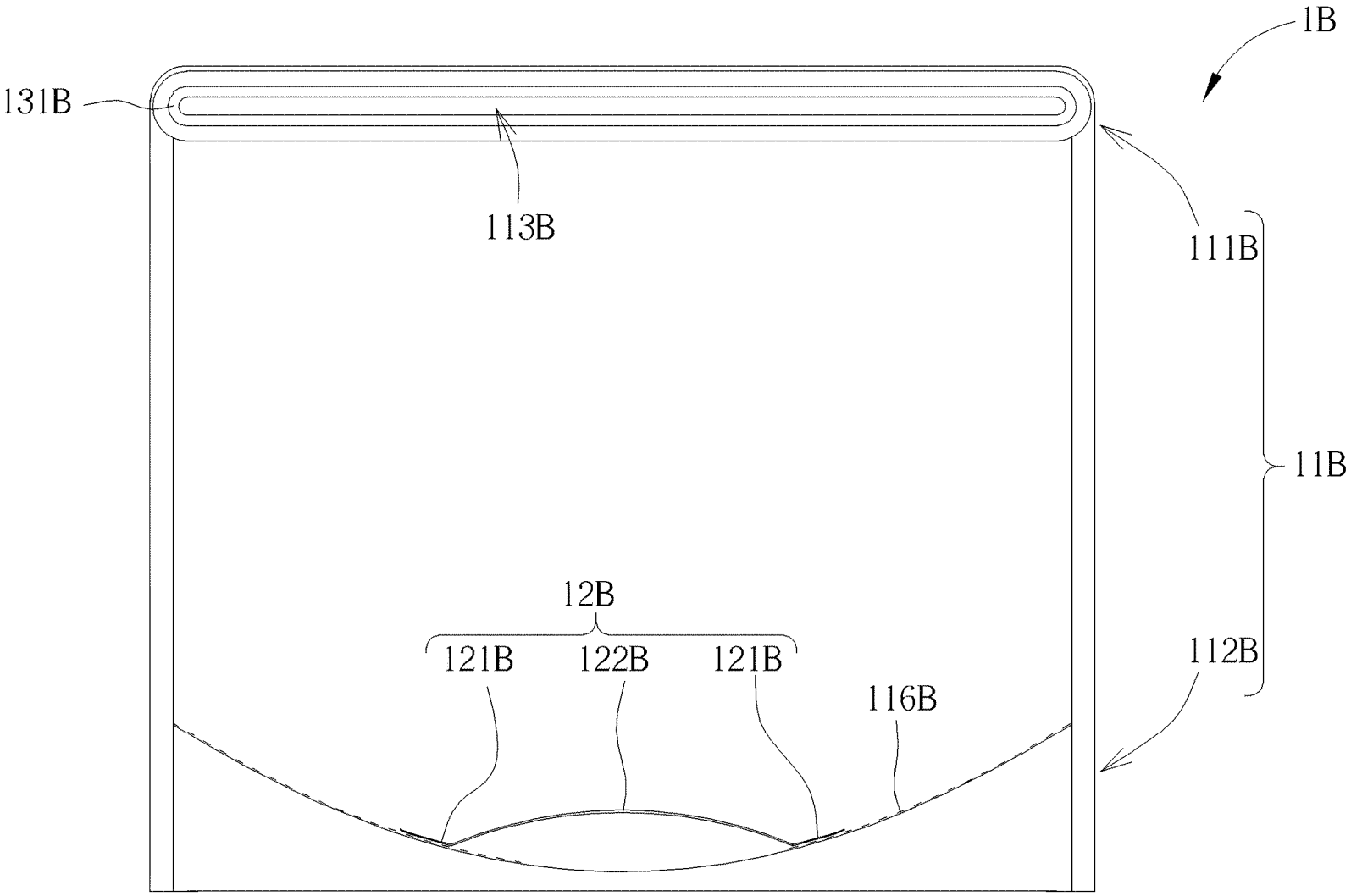
FIG. 5 is a partial diagram of the storage bag according to the second embodiment of the present invention.
Figure 6:
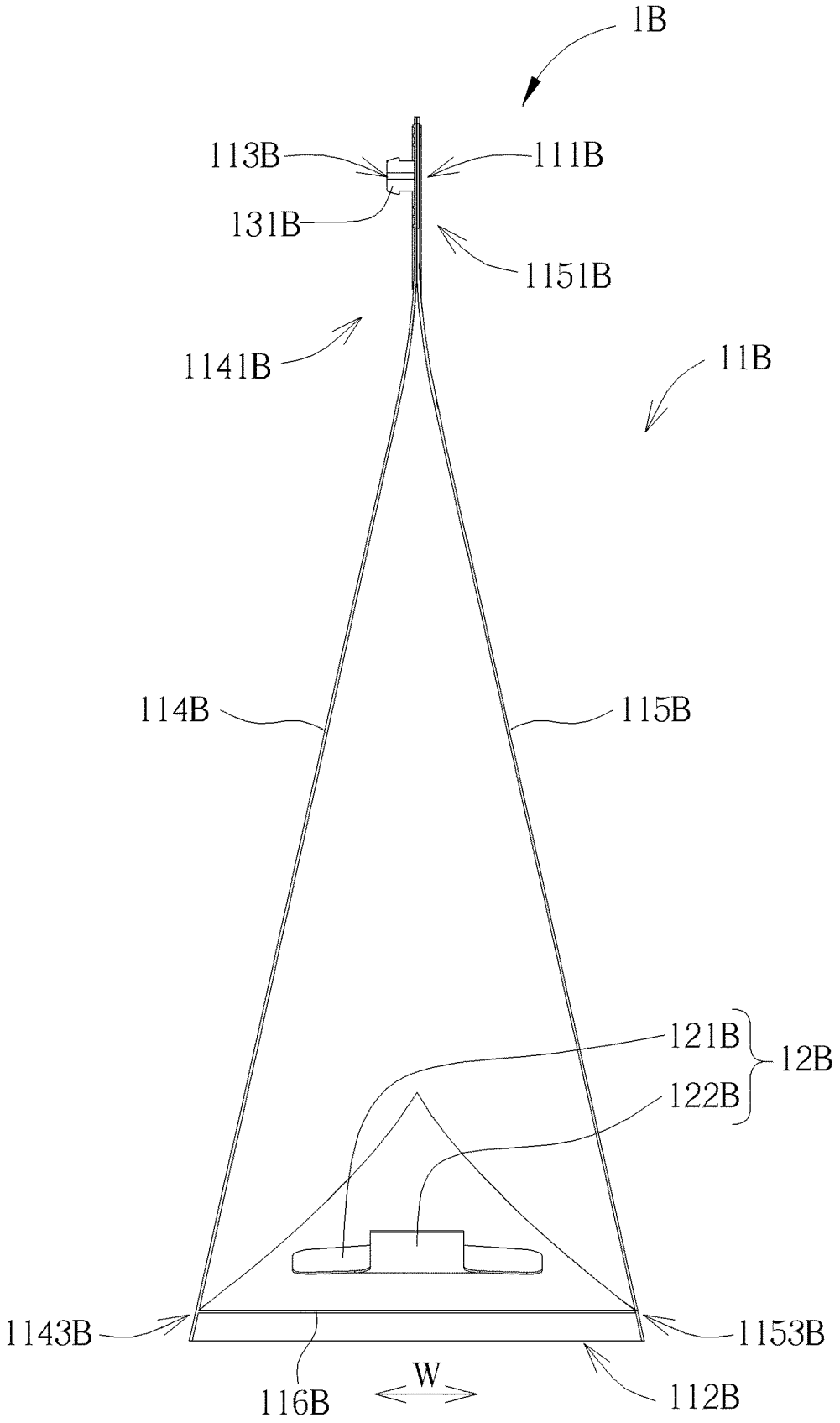
FIG. 6 is a partial sectional diagram of the storage bag according to the second embodiment of the present invention.

Please refer to FIG. 4 to FIG. 6. FIG. 4 is a partial perspective diagram of a storage bag 1B according to a second embodiment of the present invention. FIG. 5 is a partial diagram of the storage bag 1B according to the second embodiment of the present invention. FIG. 6 is a partial sectional diagram of the storage bag 1B according to the second embodiment of the present invention. As shown in FIG. 4 to FIG. 6, the storage bag 1B includes a bag body 11B, a first operating component 12B and a sealing system 13B. Structures of the bag body 11B and the sealing system 13B of this embodiment are similar to structures of the bag body 11A and the sealing system 13A of the first embodiment. Detailed description of the bag body 11B and the sealing system 13B is omitted herein for simplicity. Different from the first operating component 12A of the first embodiment, two end portions 121B of the first operating component 12B are arranged along a longitudinal direction L perpendicular to the wide direction W and connected to a bottom layer 116B of the bag body 11B. A middle portion 122B of the first operating component 12B between the two end portions 121B of the first operating component 12B is separated from the bottom layer 116B, and an operating space 123B is formed between the middle portion 122B of the first operating component 12B and the bottom layer 116B.

When it is desired to flip the bag body 11B inside out, the user can insert his/her hand into the bag body 11B through an opening 113B and stretch his/her finger through the operating space 123B to pull the first operating component 12B upwardly, so as to flip the bag body 11B inside out, which makes it easy to clean the interior of the bag body 11B thoroughly.

Figure 7:
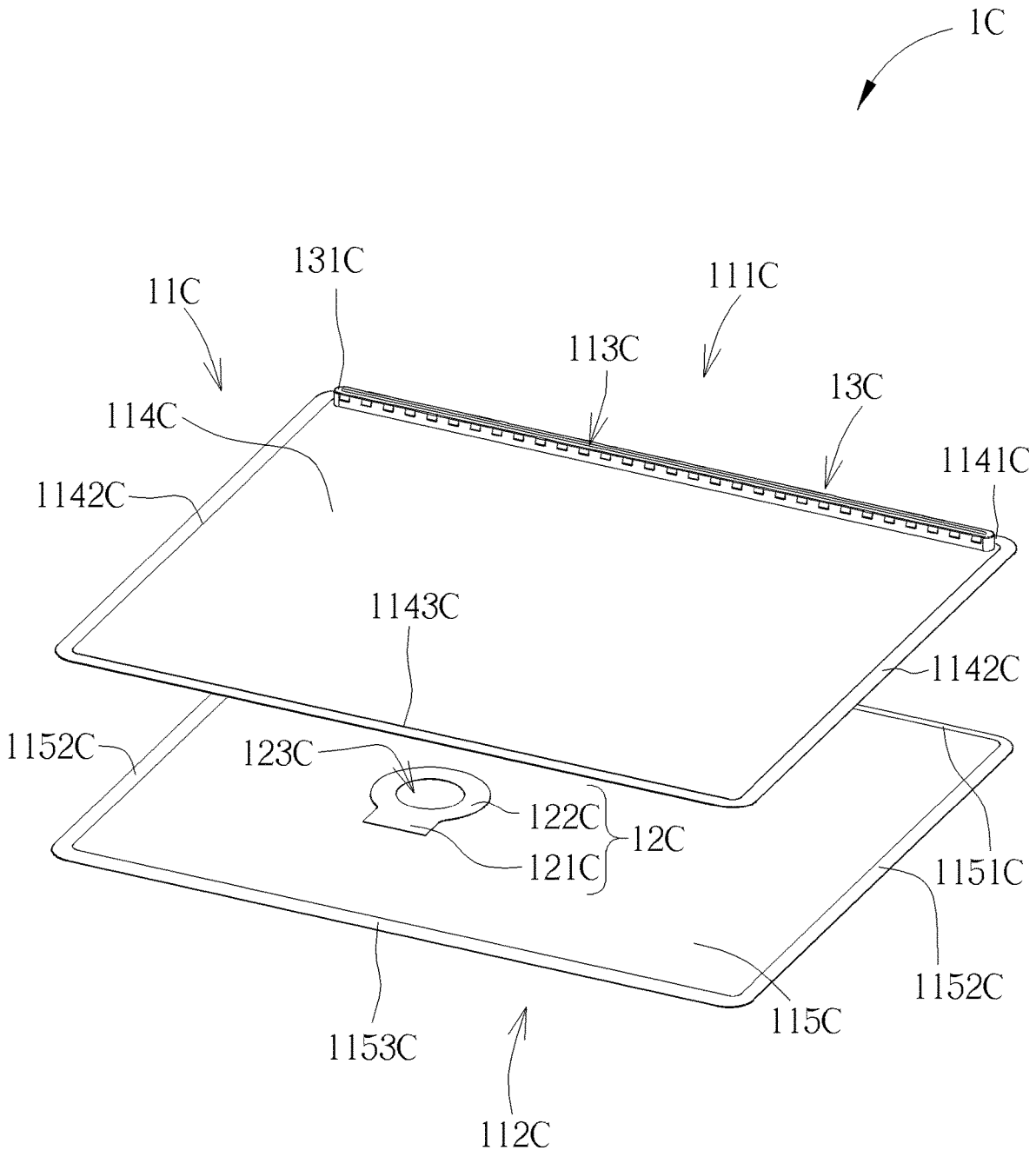
FIG. 7 is a partial exploded diagram of a storage bag according to a third embodiment of the present invention.
Figure 8:
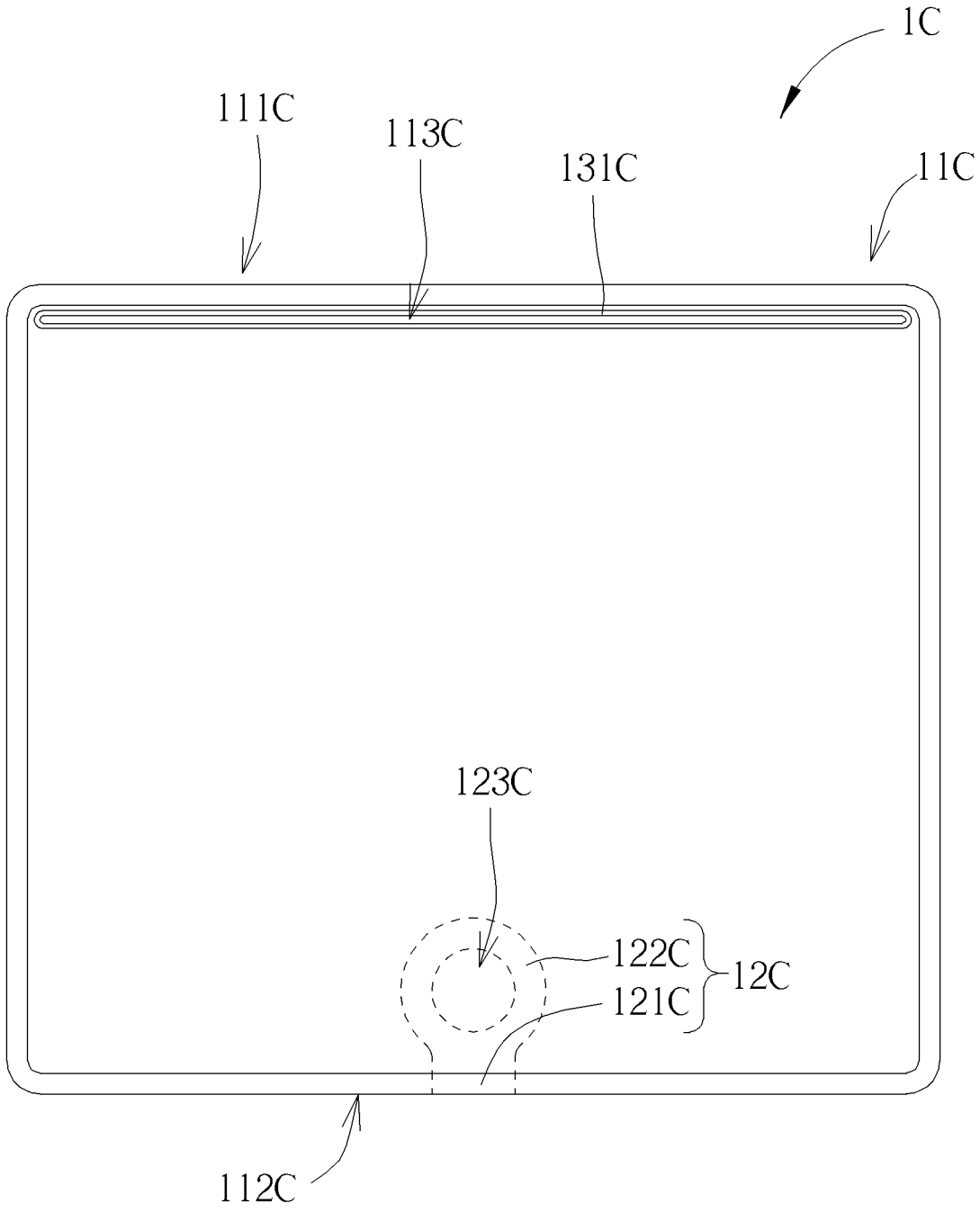
FIG. 8 is a partial diagram of the storage bag according to the third embodiment.

Please refer to FIG. 7 to FIG. 8. FIG. 7 is a partial exploded diagram of a storage bag 1C according to a third embodiment of the present invention. FIG. 8 is a partial diagram of the storage bag 1C according to the third embodiment. As shown in FIG. 7 to FIG. 8, the storage bag 1C includes a bag body 11C, a first operating component 12C and a sealing system 13C. Structure of the sealing system 13C of this embodiment is similar to structure of the sealing systems 13A, 13B of the aforementioned embodiments. Detailed description of the sealing system 13C is omitted herein for simplicity. Different from the aforementioned embodiments, the bag body 11C of this embodiment includes a first layer 114C and a second layer 115C, and there is no bottom layer for the bag body 11C. A top portion 1141C of the first layer 114C is connected to a top portion 1151C of the second layer 115C. An opening 113C is formed on the top portion 1141C of the first layer 114C. Two lateral portions 1142C of the first layer 114C are respectively connected to two lateral portions 1152C of the second layer 115C. A bottom portion 1143C of the first layer 114C is connected to a bottom portion 1153C of the second layer 115C. A top portion 1141C of the first layer 114C is connected to a top portion 1151C of the second layer 115C. The top portion 1141C of the first layer 114C and the top portion 1151C of the second layer 115C cooperatively form a top portion 111C of the bag body 11C. The bottom portion 1143C of the first layer 114C and the bottom portion 1153C of the second layer 115C cooperatively form a bottom portion 112C of the bag body 11C. A portion of the first operating component 12C is located between and connected to the bottom portion 1143C of the first layer 114C and the bottom portion 1153C of the second layer 115C. Specifically, the first operating component 12C includes a connecting end 121C and an operating end 122C away from the connecting end 121C. The connecting end 121C of the first operating component 12C is connected to and located between the bottom portion 1143C of the first layer 114C and the bottom portion 1153C of the second layer 115C. An operating space 123C is formed on the operating end 122C of the first operating component 12C.

When it is desired to flip the bag body 11C inside out, the user can insert his/her hand into the bag body 11C through the opening 113C and stretch his/her finger through the operating space 123C to pull the first operating component 12C upwardly, so as to flip the bag body 11C inside out, which makes it easy to clean the interior of the bag body 11C thoroughly.

Figure 9:
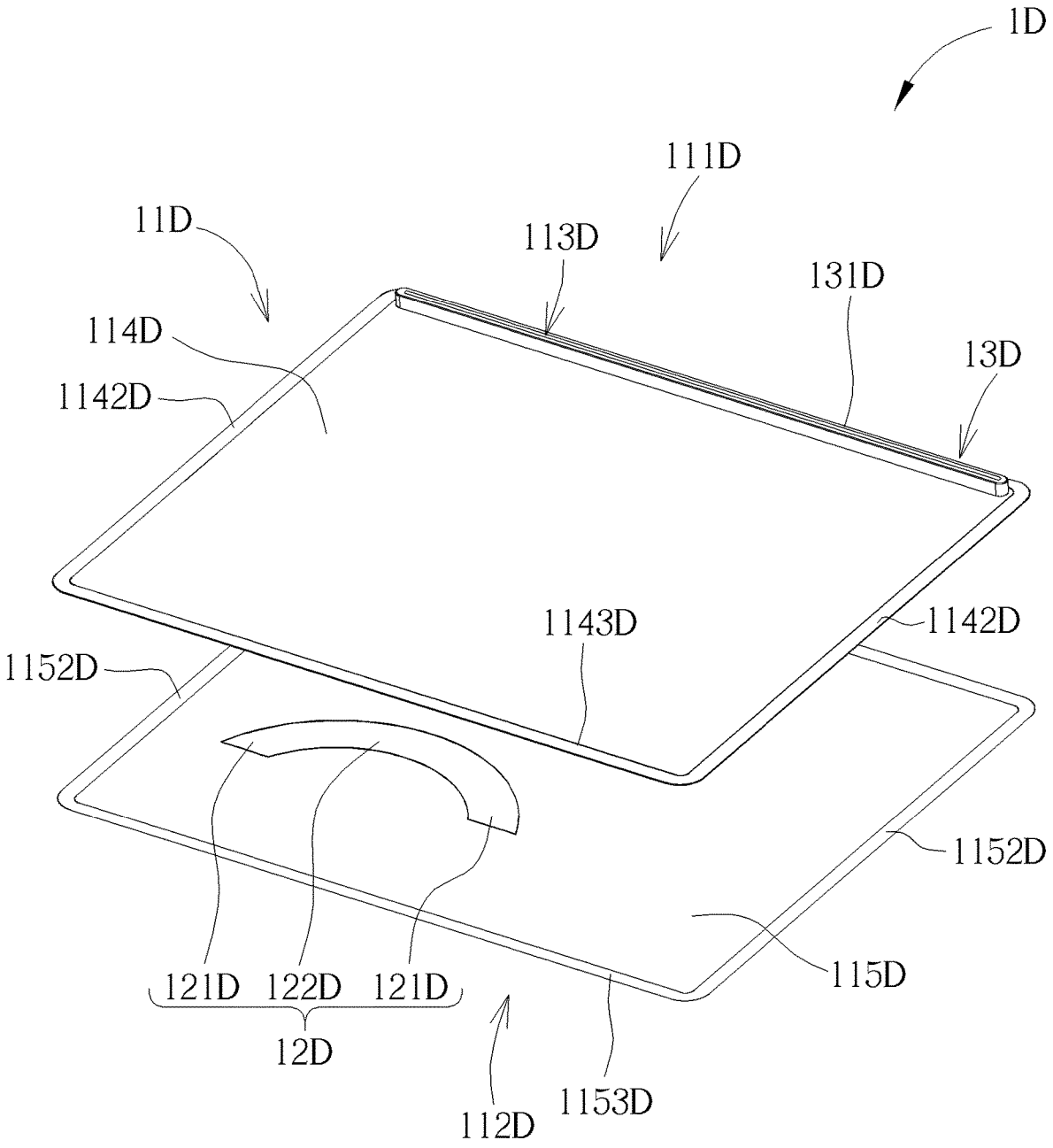
FIG. 9 is a partial exploded diagram of a storage bag according to a third embodiment of the present invention.
Figure 10:
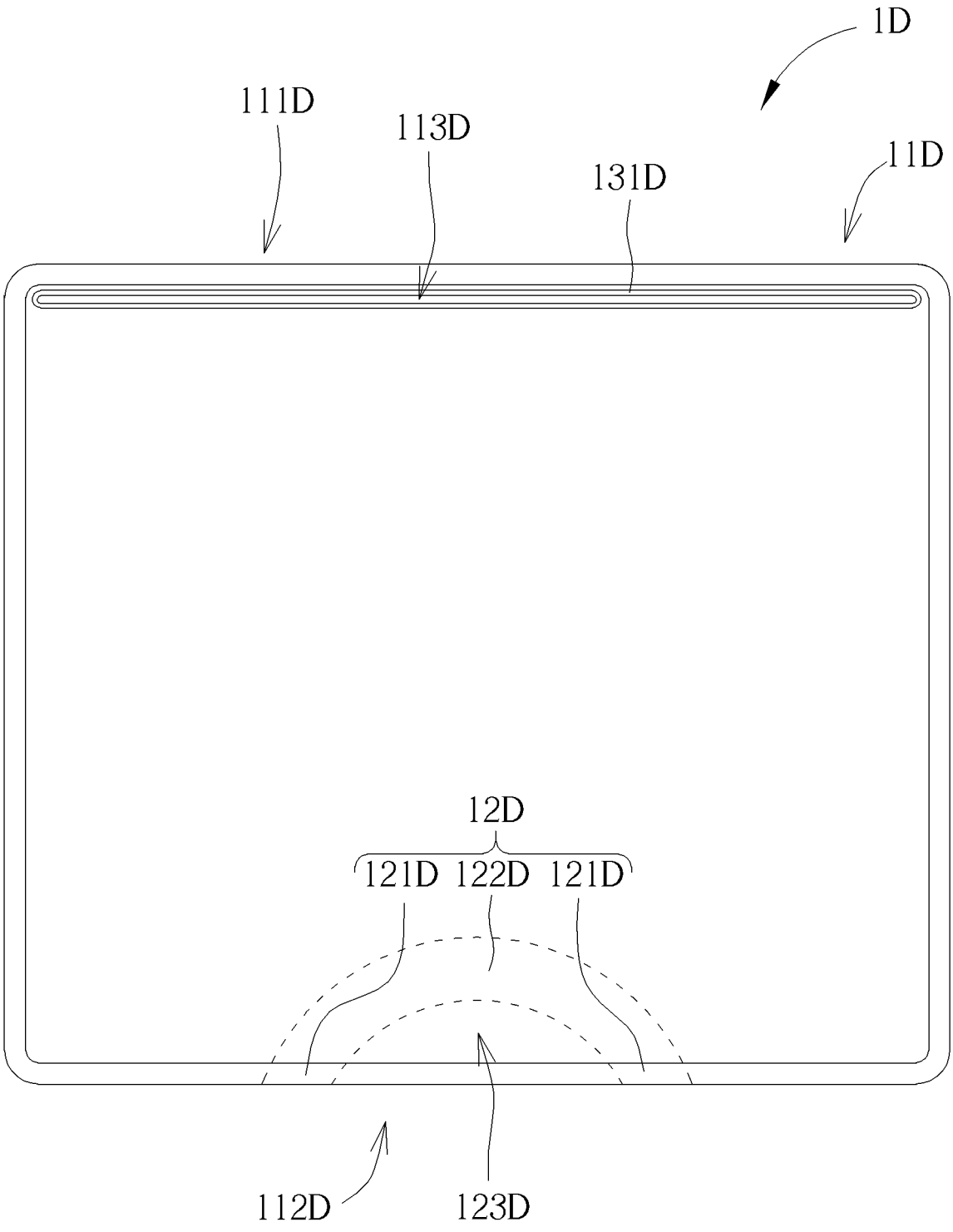
FIG. 10 is a partial diagram of the storage bag according to the third embodiment.

Please refer to FIG. 9 to FIG. 10. FIG. 9 is a partial exploded diagram of a storage bag 1D according to a third embodiment of the present invention. FIG. 10 is a partial diagram of the storage bag 1D according to the third embodiment. As shown in FIG. 9 to FIG. 10, the storage bag 1D includes a bag body 11D, a first operating component 12D and a sealing system 13D. Structures of the bag body 11D and the sealing system 13D of this embodiment are similar to structures of the bag body 11C and the sealing system 13C of the third embodiment. Detailed description of the bag body 11D and the sealing system 13D is omitted herein for simplicity. Different from the first operating component 12C of the third embodiment, two end portions 121D of the first operating component 12D are arranged along the longitudinal direction L and connected to a bottom portion 1143D of a first layer 114D of the bag body 11D and a bottom portion 1153D of a second layer 115D of the bag body 11D. A middle portion 122D of the first operating component 12D between the two end portions 121D of the first operating component 12D is separated from the bottom portion 1143D of the first layer 114D and the bottom portion 1153D of the second layer 115D. An operating space 123D is formed between the middle portion 122D of the first operating component 12D and a bottom portion 112D of the bag body 11D.

When it is desired to flip the bag body 11D inside out, the user can insert his/her hand into the bag body 11D through an opening 113D and stretch his/her finger through the operating space 123D to pull the first operating component 12D upwardly, so as to flip the bag body 11D inside out, which makes it easy to clean the interior of the bag body 11D thoroughly.

Figure 11:
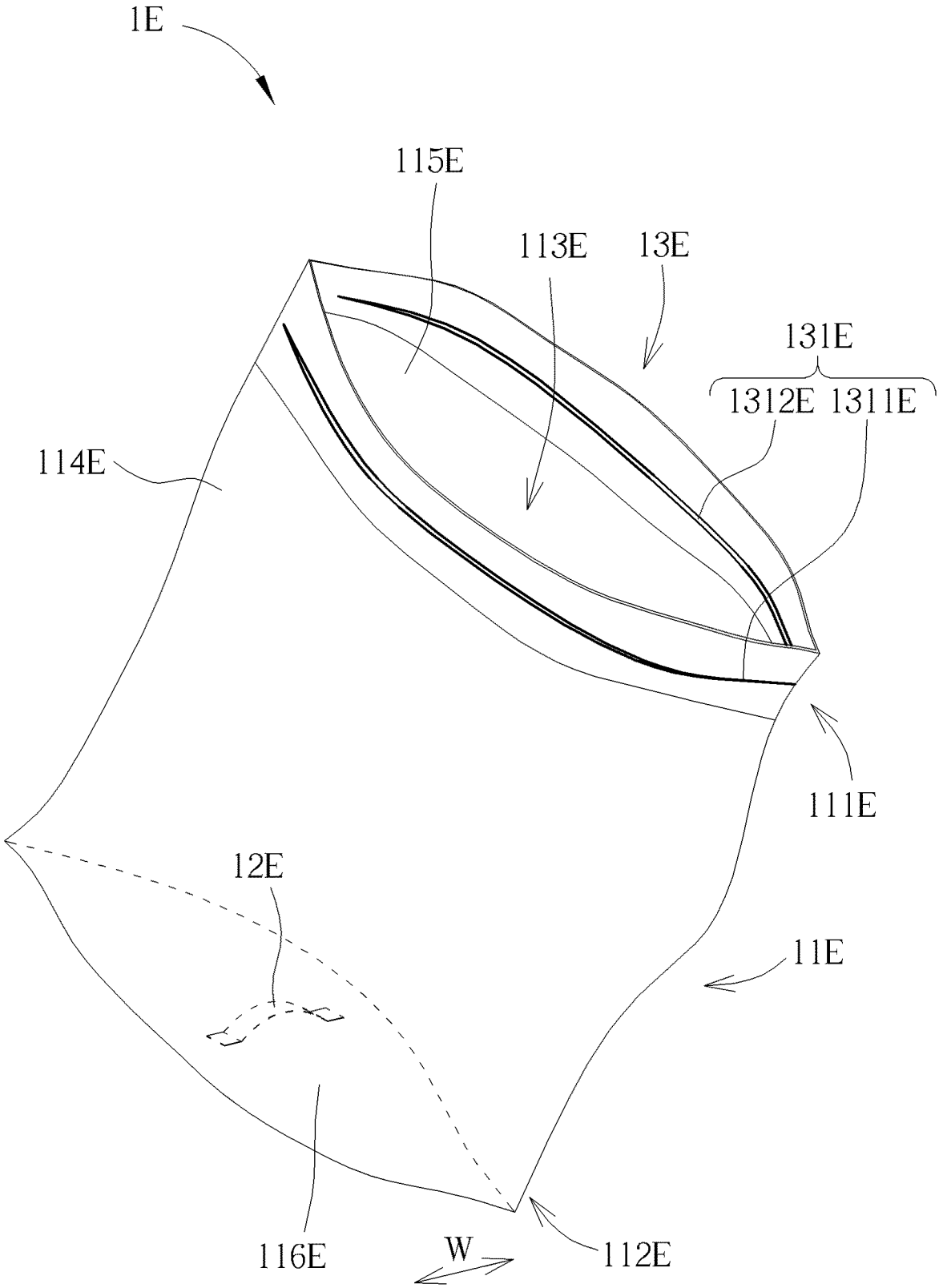
FIG. 11 is a perspective diagram of a storage bag according to a fifth embodiment of the present invention.

Please refer to FIG. 11. FIG. 11 is a perspective diagram of a storage bag 1E according to a fifth embodiment of the present invention. As shown in FIG. 11, the storage bag 1E includes a bag body 11E, a first operating component 12E and a sealing system 13E. The bag body 11E includes a first layer 114E, a second layer 115E and a bottom layer 116E. An opening 113E is formed between a top portion of the first layer 114E and a top portion of the second layer 115E. Two lateral portions of the first layer 114E are respectively connected to two lateral portions of the second layer 115E. The bottom layer 116E is connected to a bottom portion of the first layer 114E and a bottom portion of the second layer 115E. Two end portions of the first operating component 12E are arranged along the wide direction W and connected to the bottom layer 116E. The top portion of the first layer 114E and the top portion of the second layer 115E cooperatively form a top portion 111E of the bag body 11E. The bottom layer 116E, the bottom portion of the first layer 114E and the bottom portion of the second layer 115E cooperatively form a bottom portion 112E of the bag body 11E. The sealing component 13E includes a zipper 131E, which includes a male member 1311E disposed on the top portion of the first layer 114E and a female member 1312E disposed on the top portion of the second layer 115E. The male member 1311E and the female member 1312E can be buckled with each other to seal the opening 113E.

Figure 12:
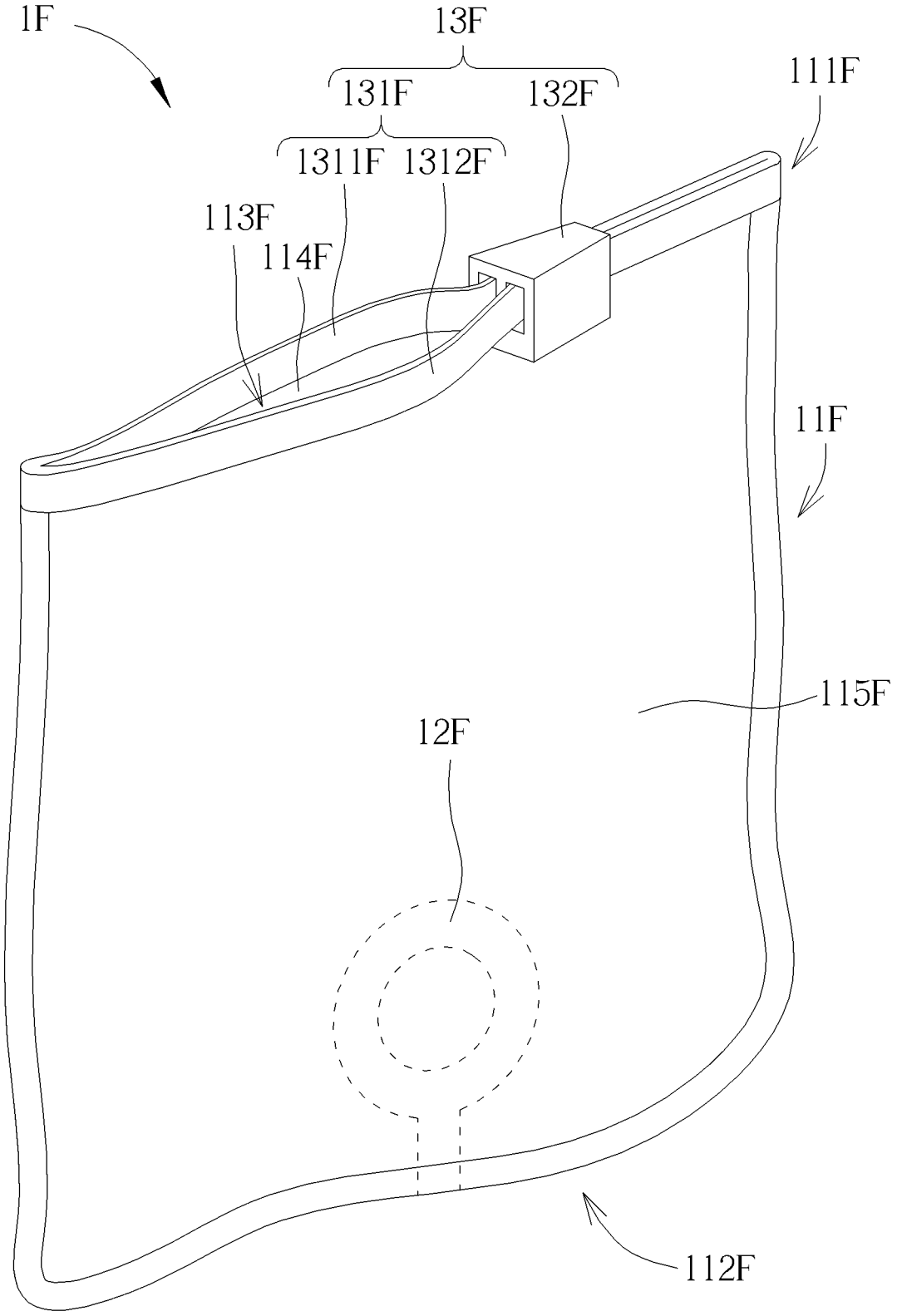
FIG. 12 is a perspective diagram of a storage bag according to a sixth embodiment of the present invention.
Figure 13:
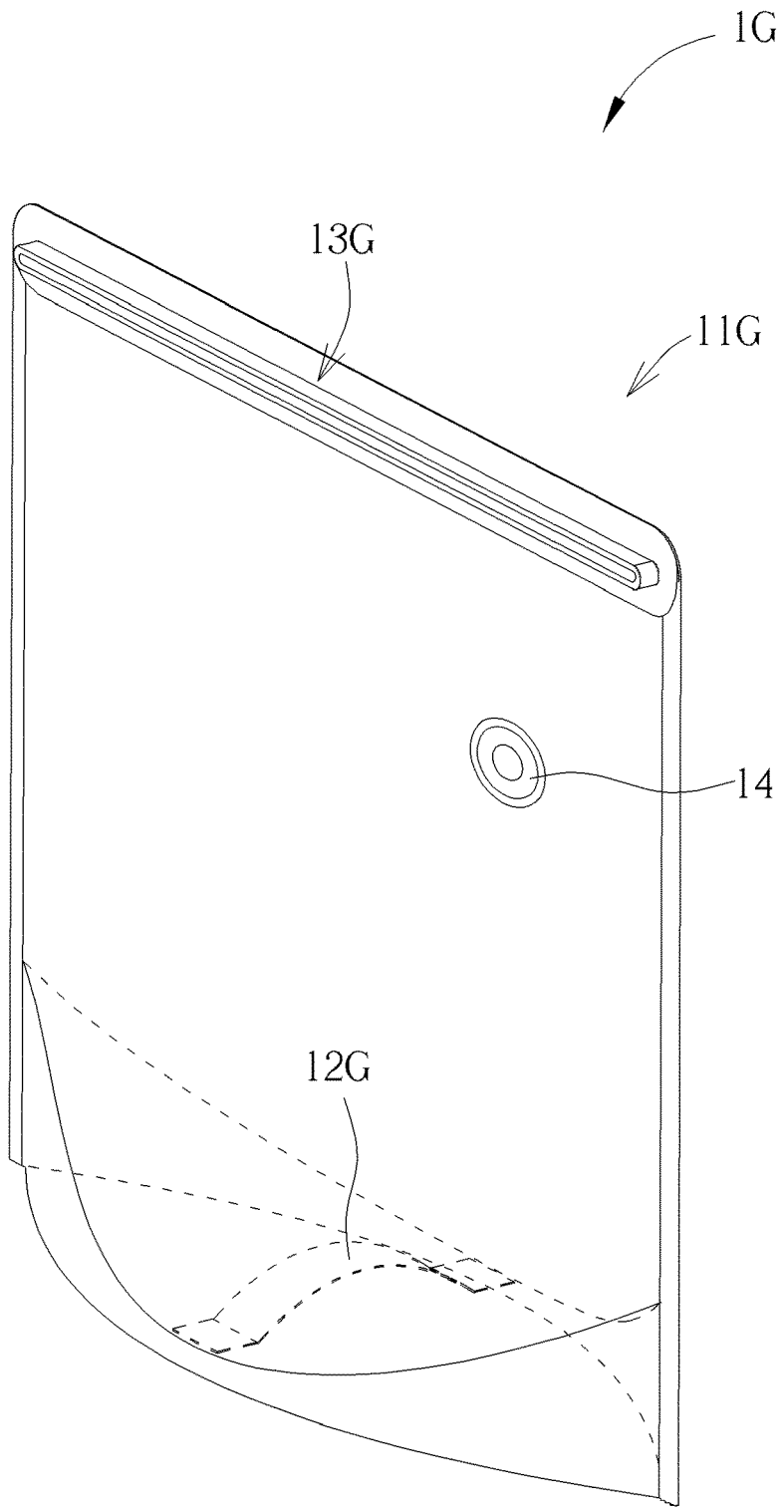
FIG. 13 to FIG. 18 are diagrams of storage bags according to different embodiments of the present invention.
Figure 14:
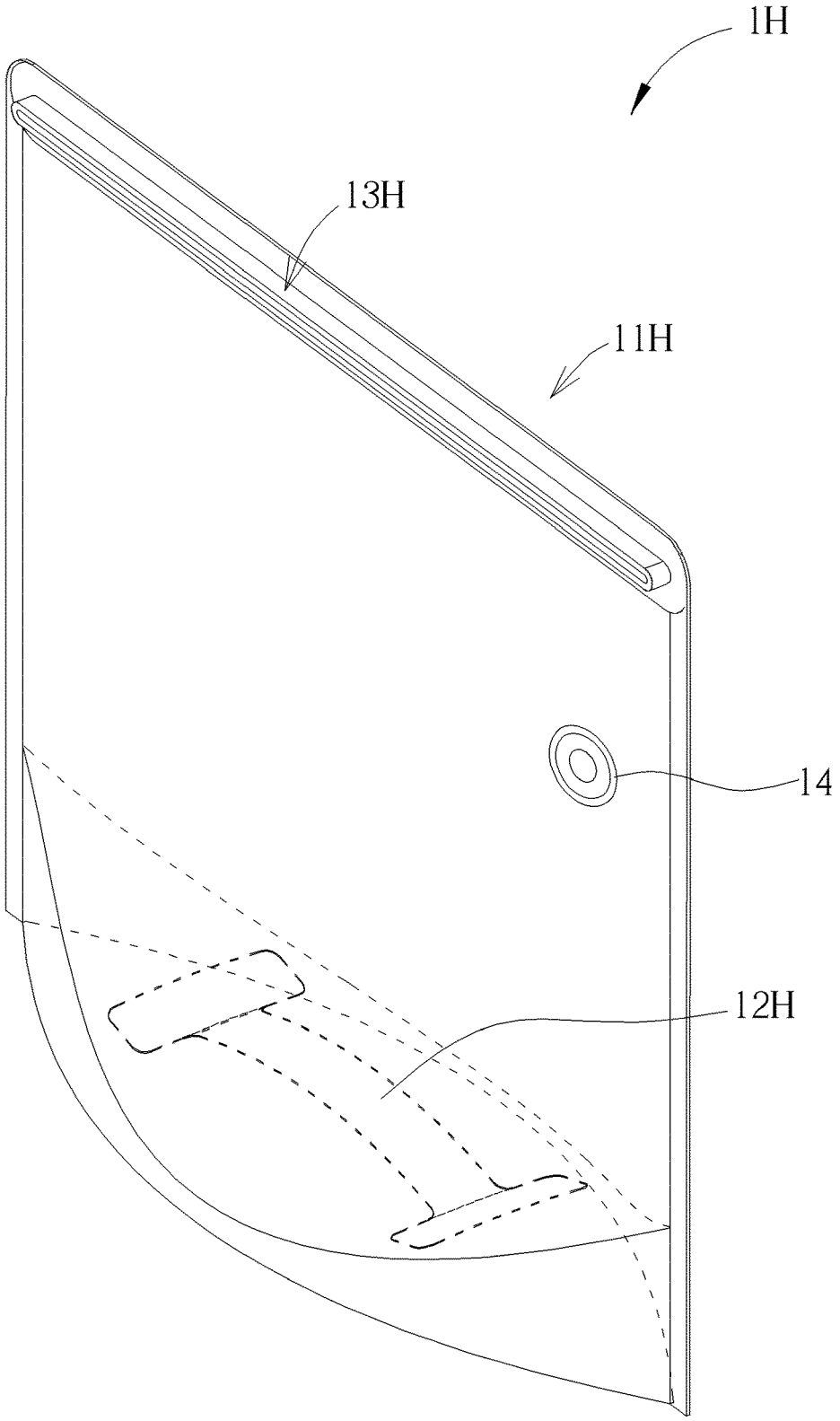
Figure 15:
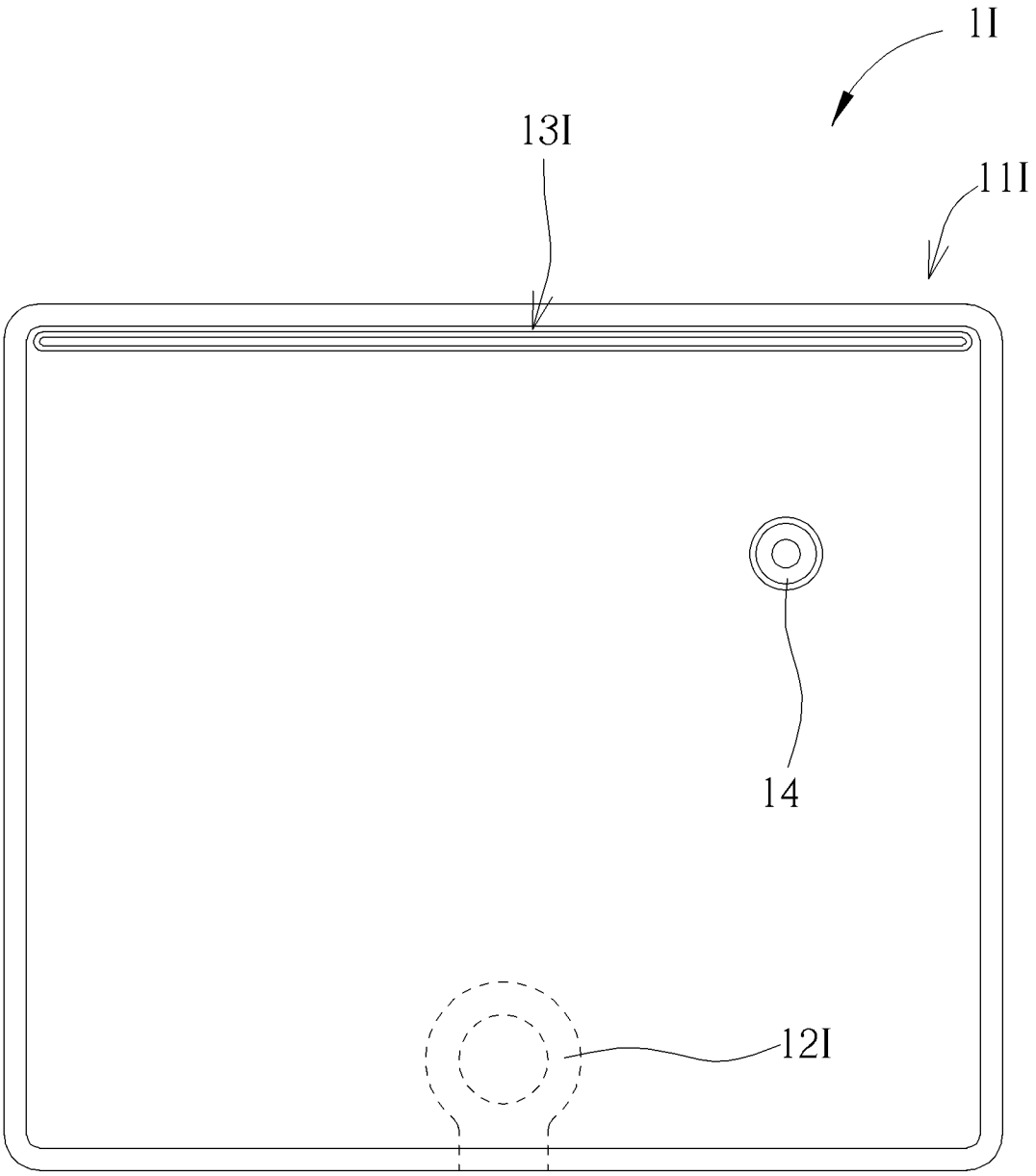
Figure 16:
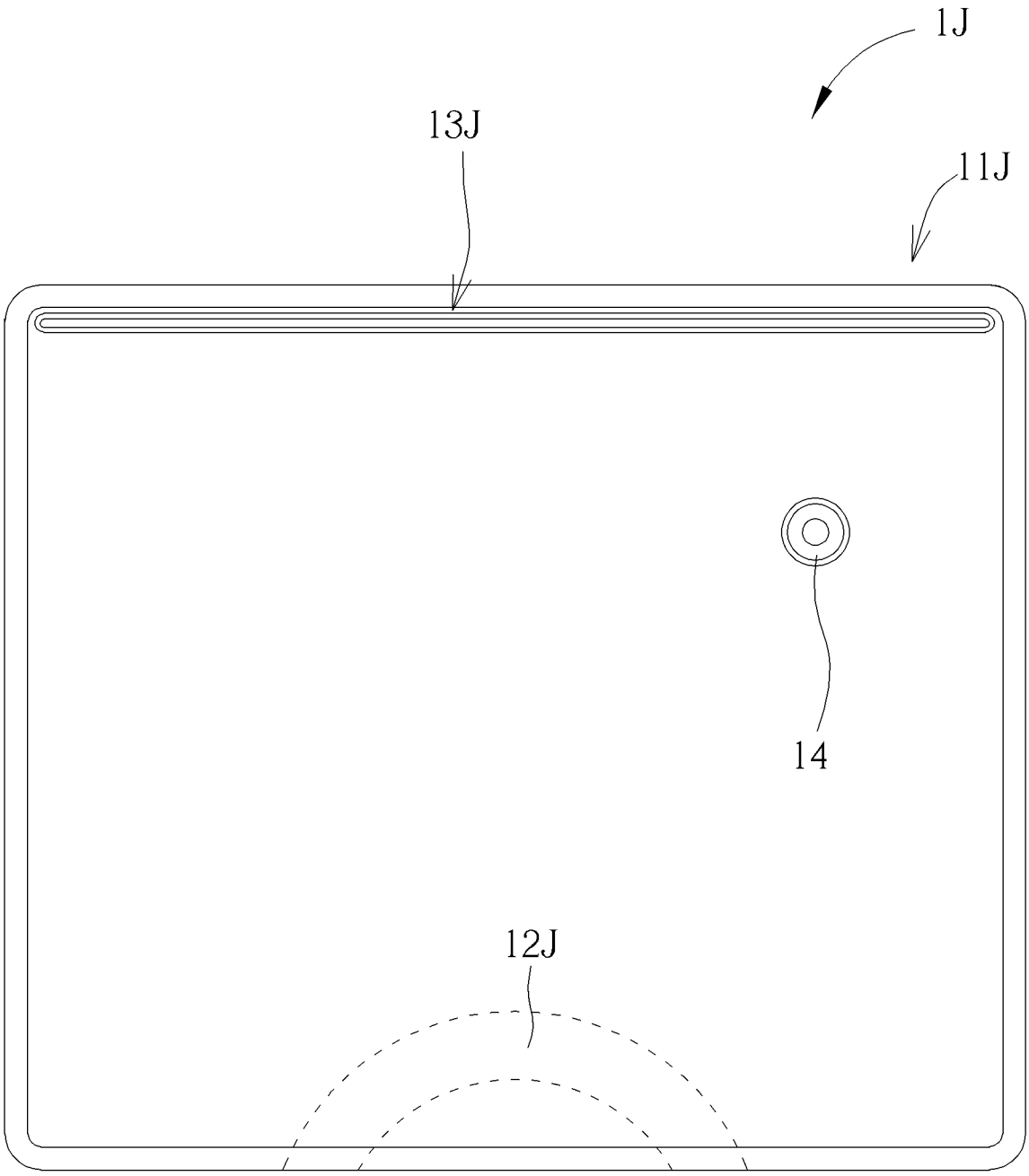
Figure 17:
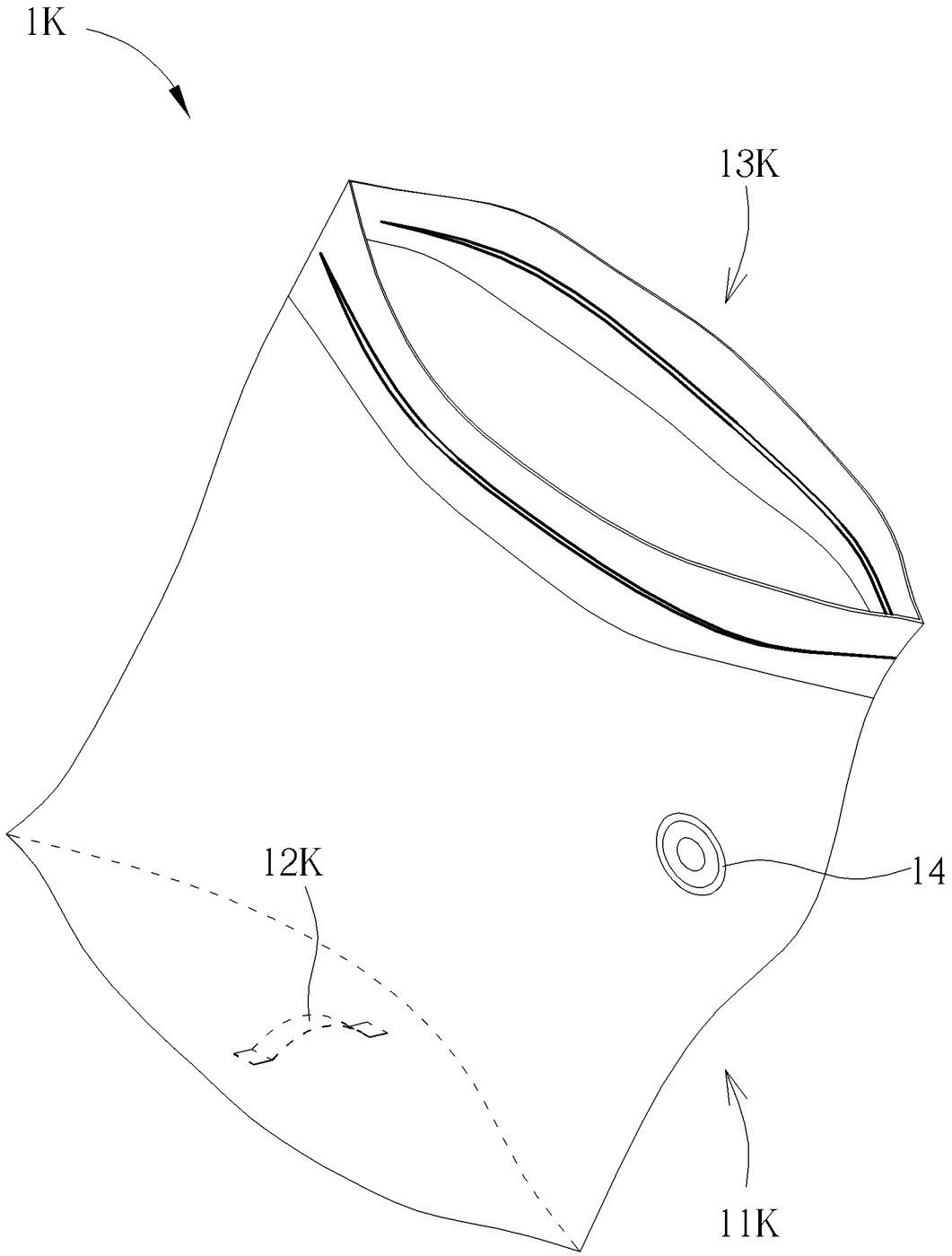
Figure 18:
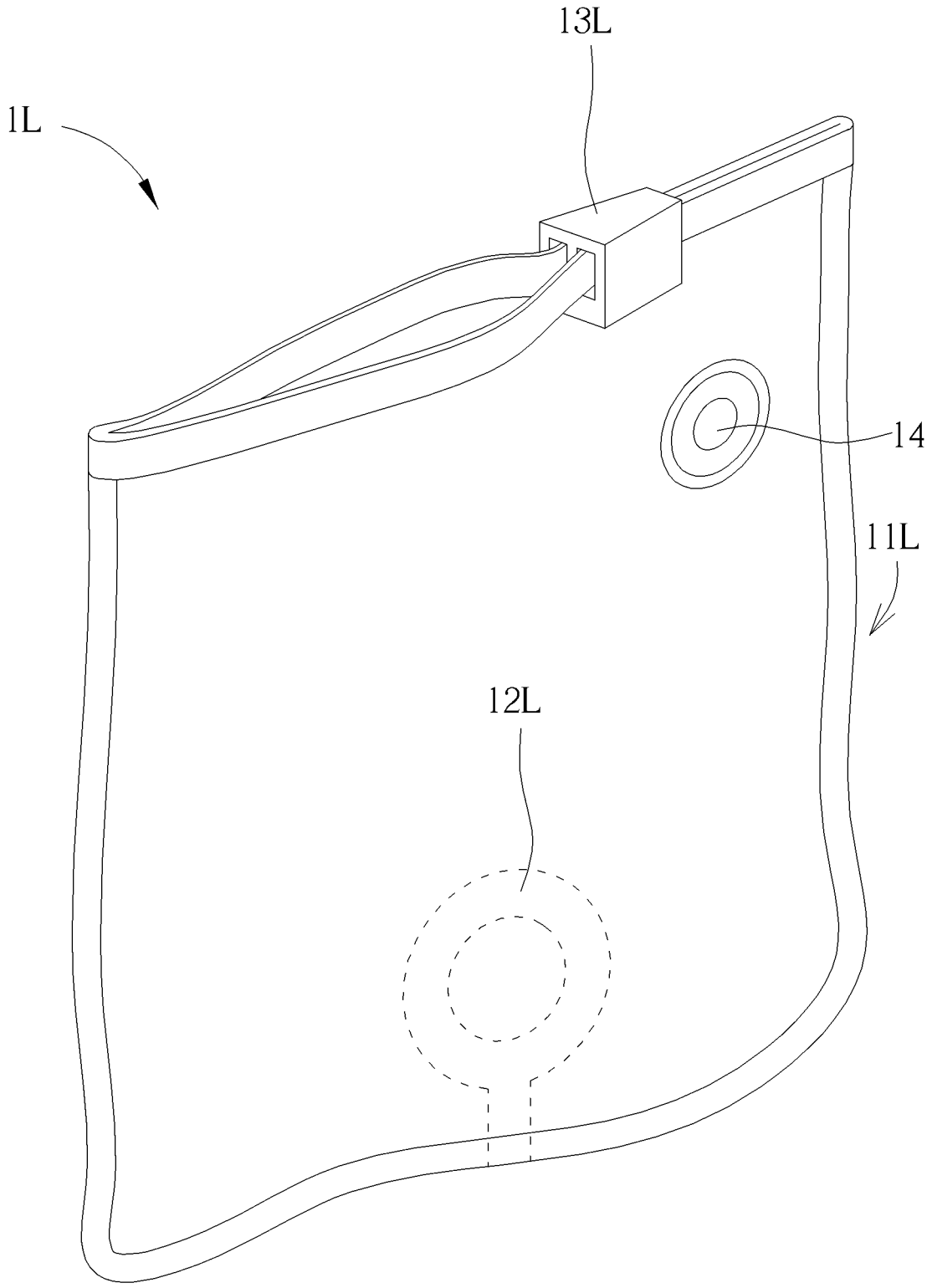

Please refer to FIG. 12. FIG. 12 is a perspective diagram of a storage bag 1F according to a sixth embodiment of the present invention. As shown in FIG. 12, the storage bag 1F includes a bag body 11F, a first operating component 12F and a sealing system 13F. The bag body 11F includes a first layer 114F and a second layer 115F. An opening 113F is formed between a top portion of the first layer 114F and a top portion of the second layer 115F. Two lateral portions of the first layer 114F are respectively connected to two lateral portions of the second layer 115F. A bottom portion of the first layer 114F is connected to a bottom portion of the second layer 115F. The top portion of the first layer 114F and the top portion of the second layer 115F cooperatively form a top portion 111F of the bag body 11F. The bottom portion of the first layer 114F and the bottom portion of the second layer 115F cooperatively form a bottom portion 112F of the bag body 11F. A connecting end of the first operating component 12F is connected between the bottom portion of the first layer 114F and the bottom portion of the second layer 115F. The sealing component 13F includes a zipper 131F, which includes a male member 1311F disposed on the top portion of the first layer 114F, and a female member 1312F disposed on the top portion of the second layer 115F, and a slider 132F slidably disposed on the male member 1311F and the female member 1312F. The male member 1311F and the female member 1312F can be buckled with each other to seal the opening 113F by sliding the slider 132F.

Furthermore, the storage bag of the present invention is not limited to the aforementioned embodiments. For example, please refer to FIG. 13 to FIG. 18. FIG. 13 to FIG. 18 are diagrams of storage bags 1G-1L according to different embodiments of the present invention. As shown in FIG. 13 to FIG. 18, the storage bags 1G-1L includes bag bodies 11G-11L, first operating components 12G-12L and sealing systems 13G-13L. The bag bodies 11G-11L, the first operating components 12G-12L and the sealing systems 13G-13L shown in FIG. 13 to FIG. 18 are respectively similar to the ones of the storage bags 1A-1F of the first embodiment to the sixth embodiment. Detailed description is omitted herein for simplicity. Furthermore, each of the storage bags 1G-1L further includes a vacuum valve 14. The vacuum valve 14 can be disposed on the first layer and can be connected to a vacuum pump to discharge fluid, such as liquid or air, inside the bag body. However, in another embodiment, the vacuum valve can be disposed on the second layer rather than the first layer.

Besides, in some embodiments, the storage bag can further include a second operating component connected to an outer side of the bottom portion of the bag body opposite to the inner side of the bottom portion of the bag body. After the bag body is flipped inside out by pulling the first operating component through the opening to clean the interior of the bag body thoroughly, the bag body can be flipped again by pulling the second operating component through the opening.

Figure 19:
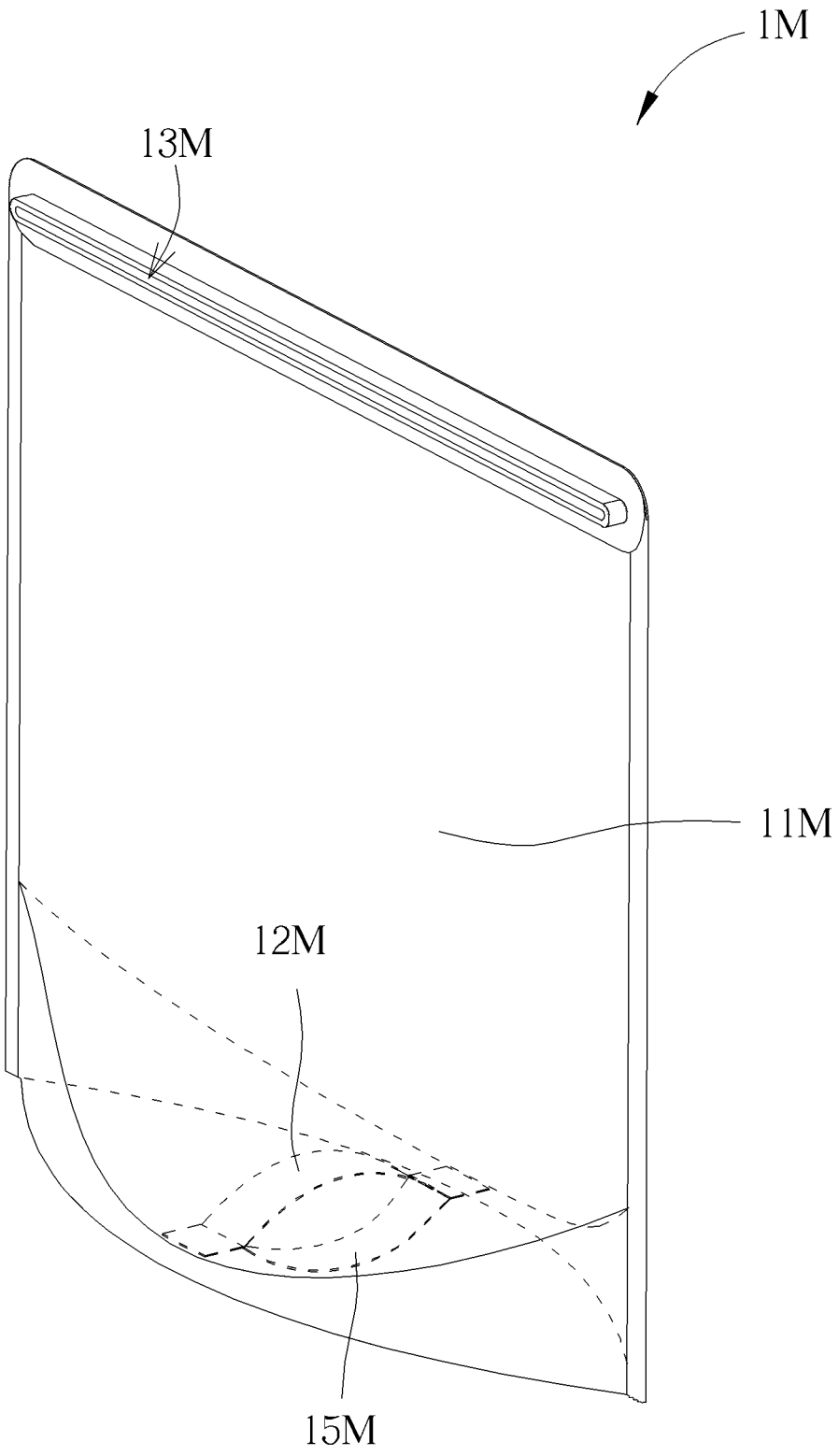
FIG. 19 to FIG. 26 are diagrams of storage bags according to different embodiments of the present invention.
Figure 20:
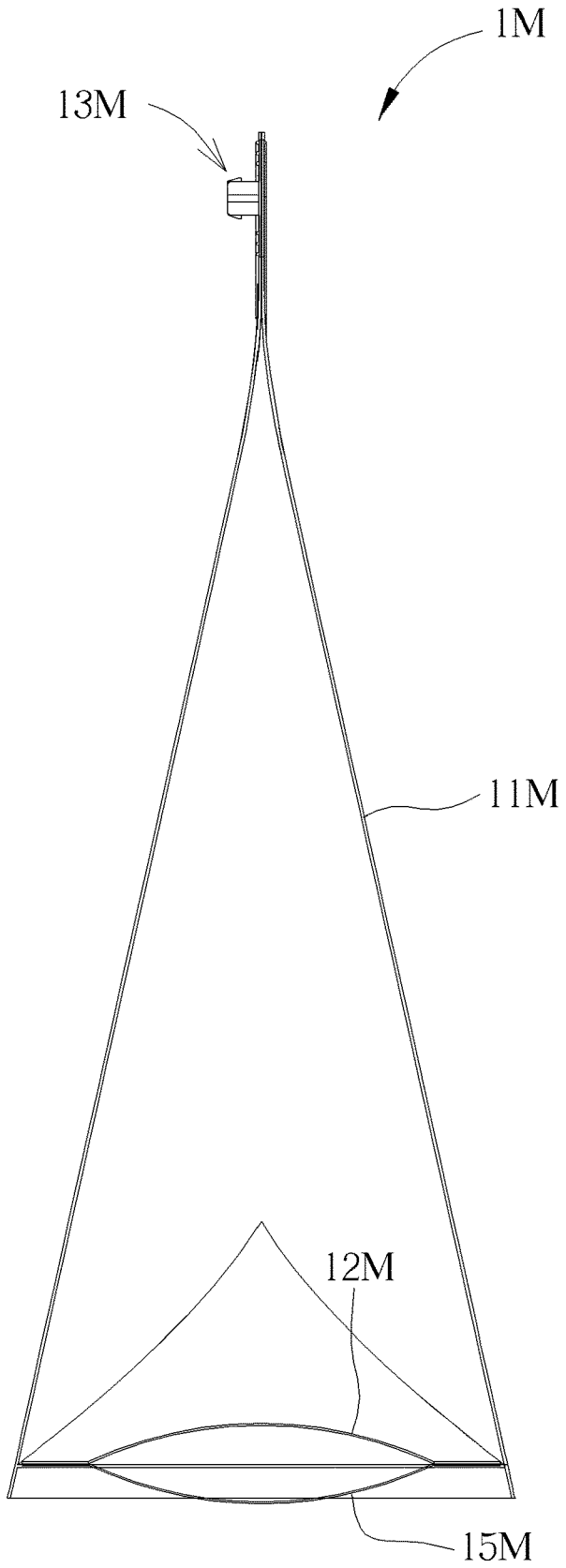
Figure 21:
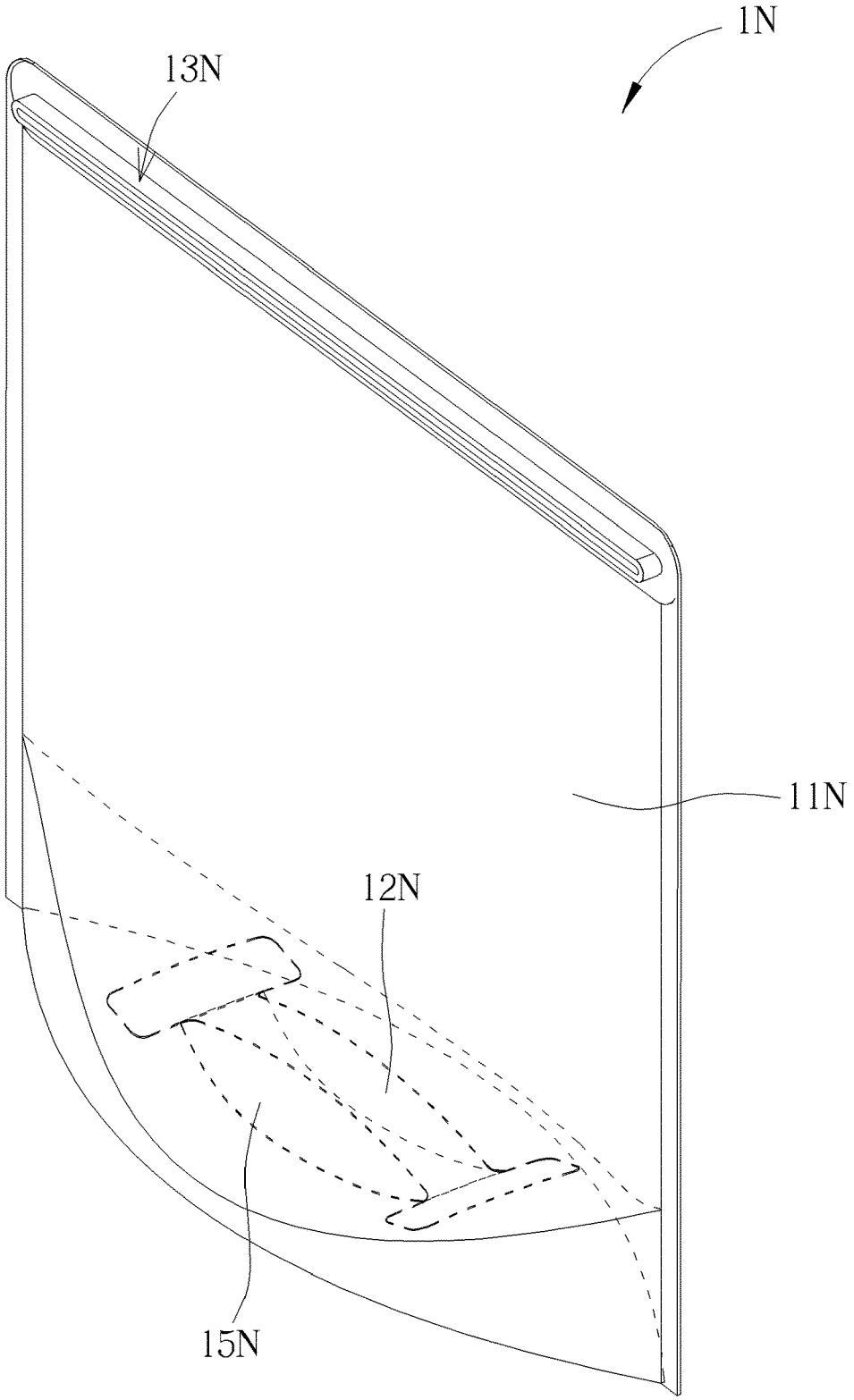
Figure 22:
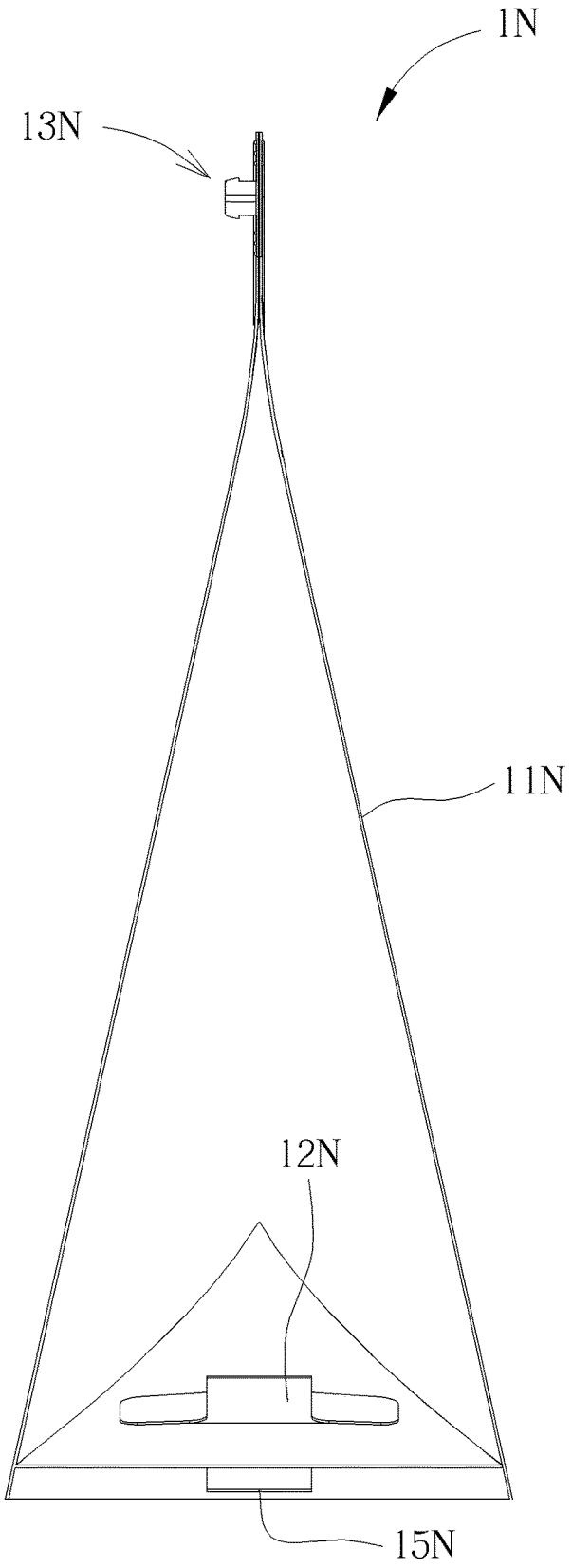
Figure 23:
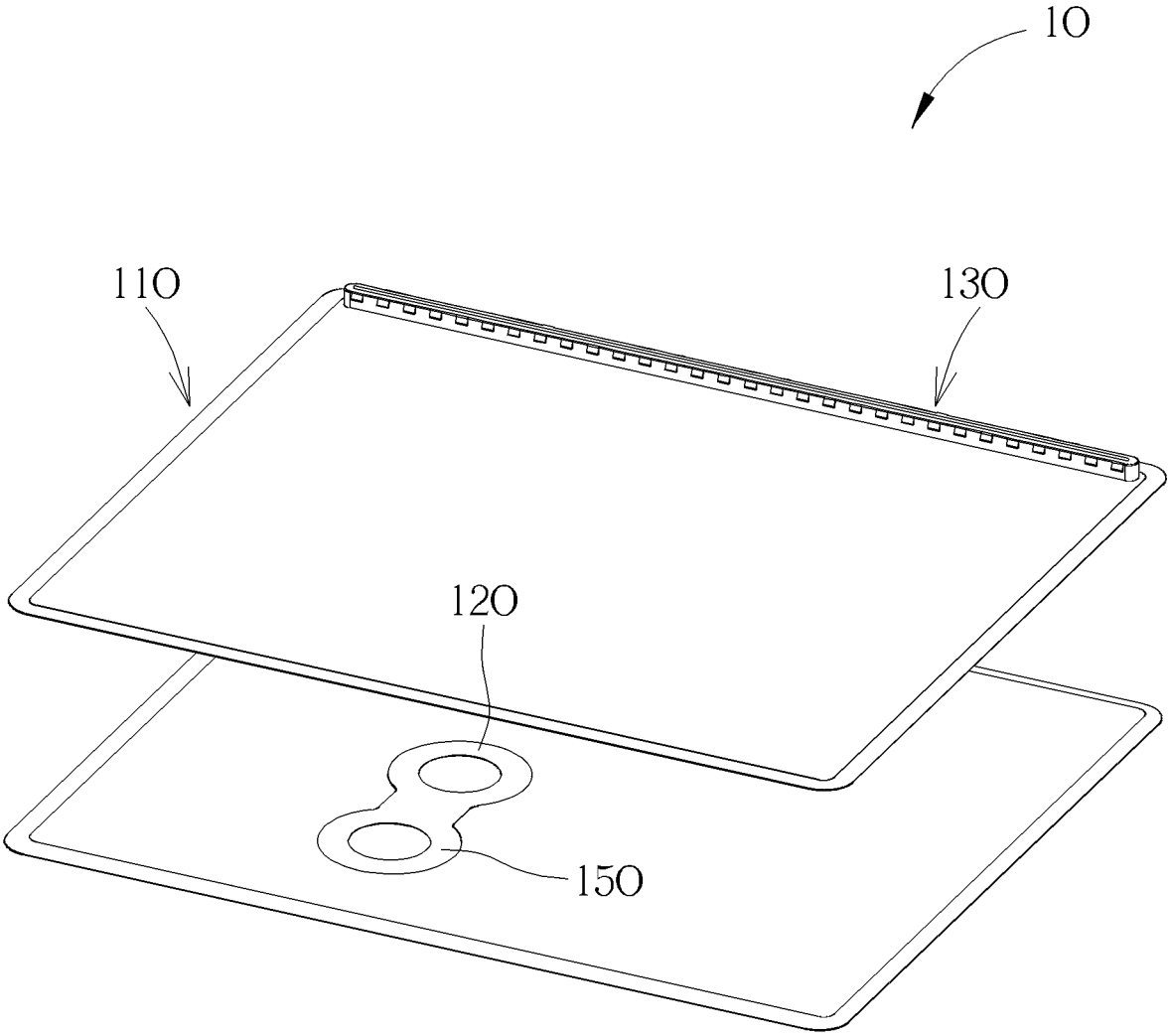
Figure 24:
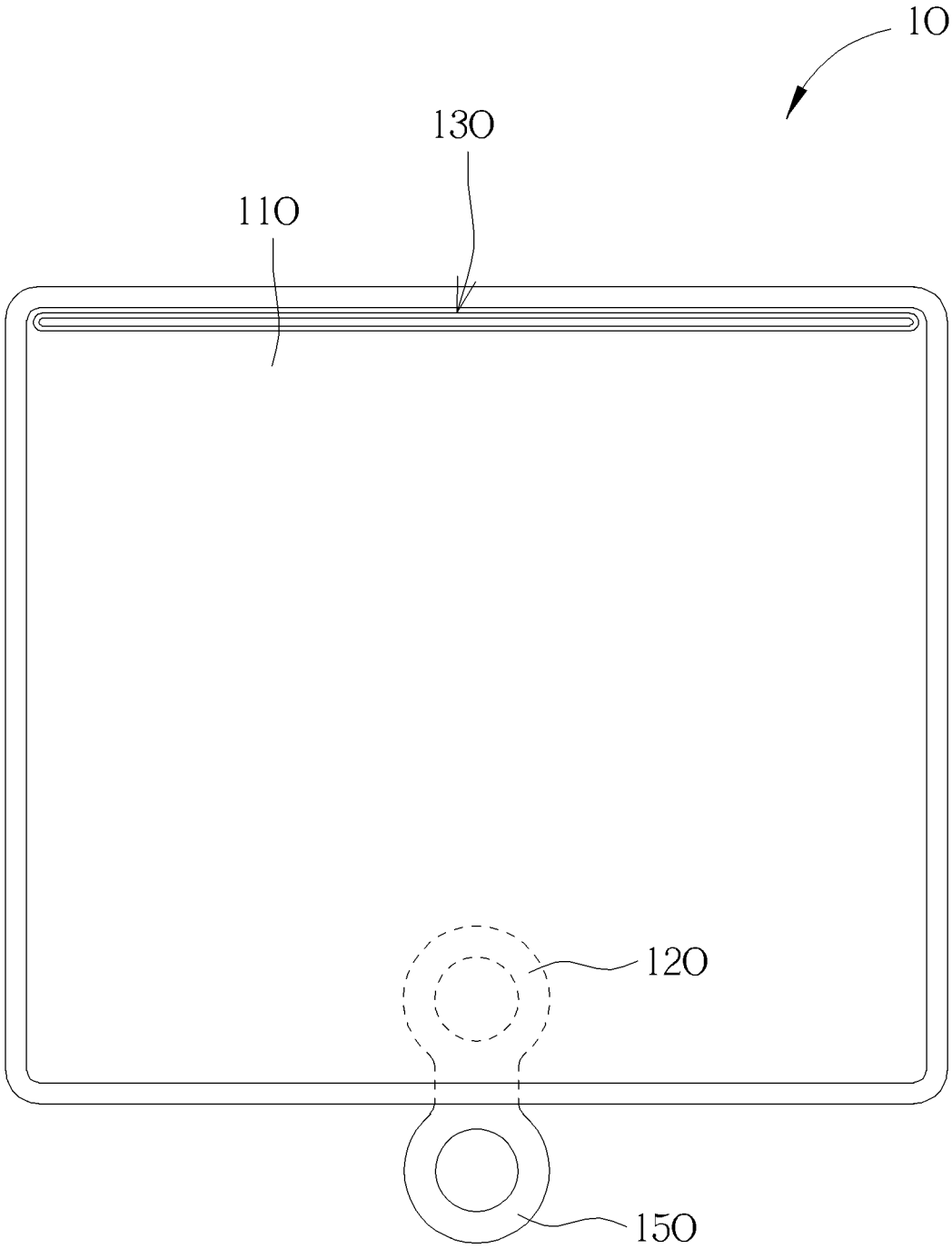
Figure 25:
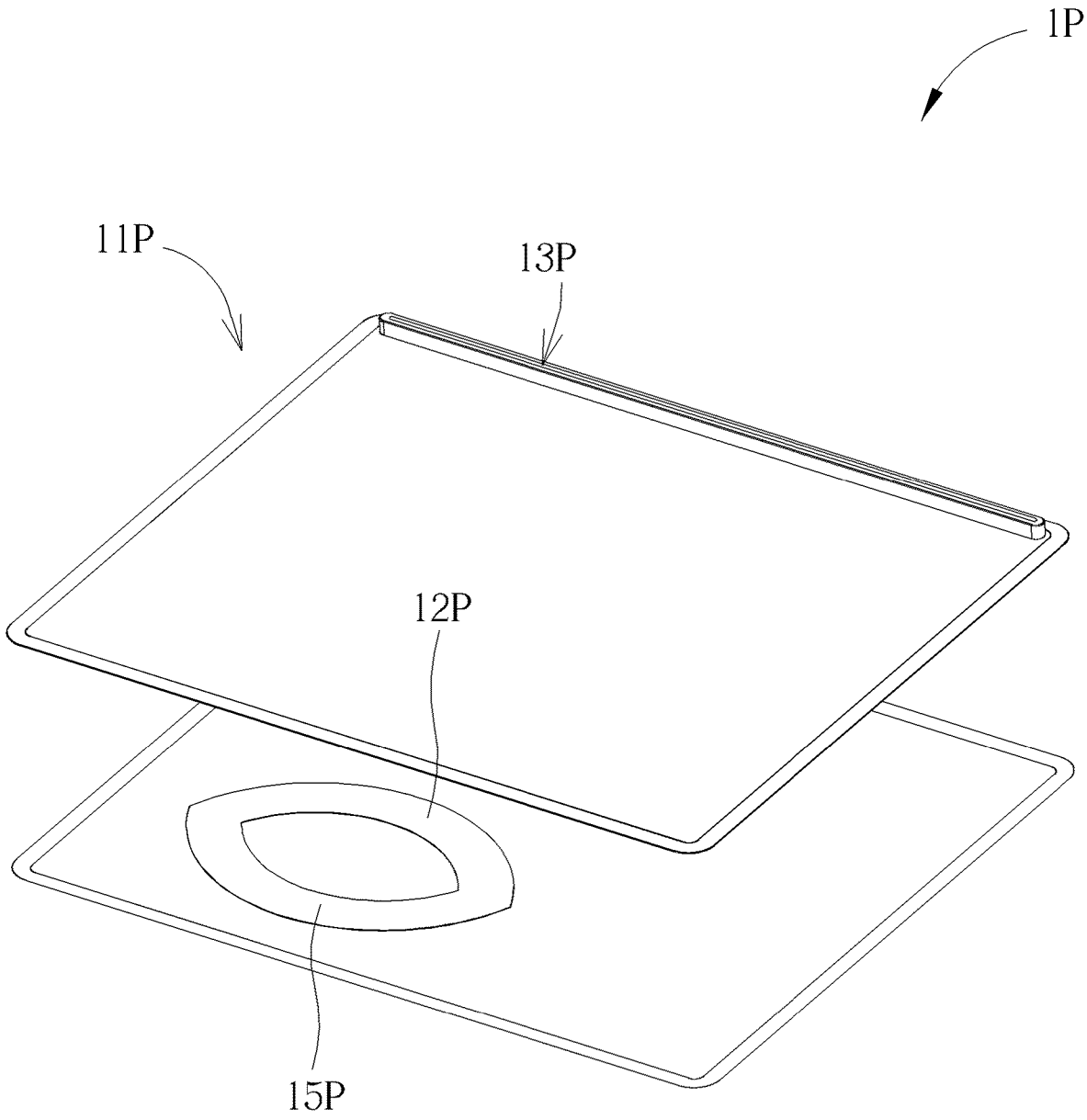
Figure 26:
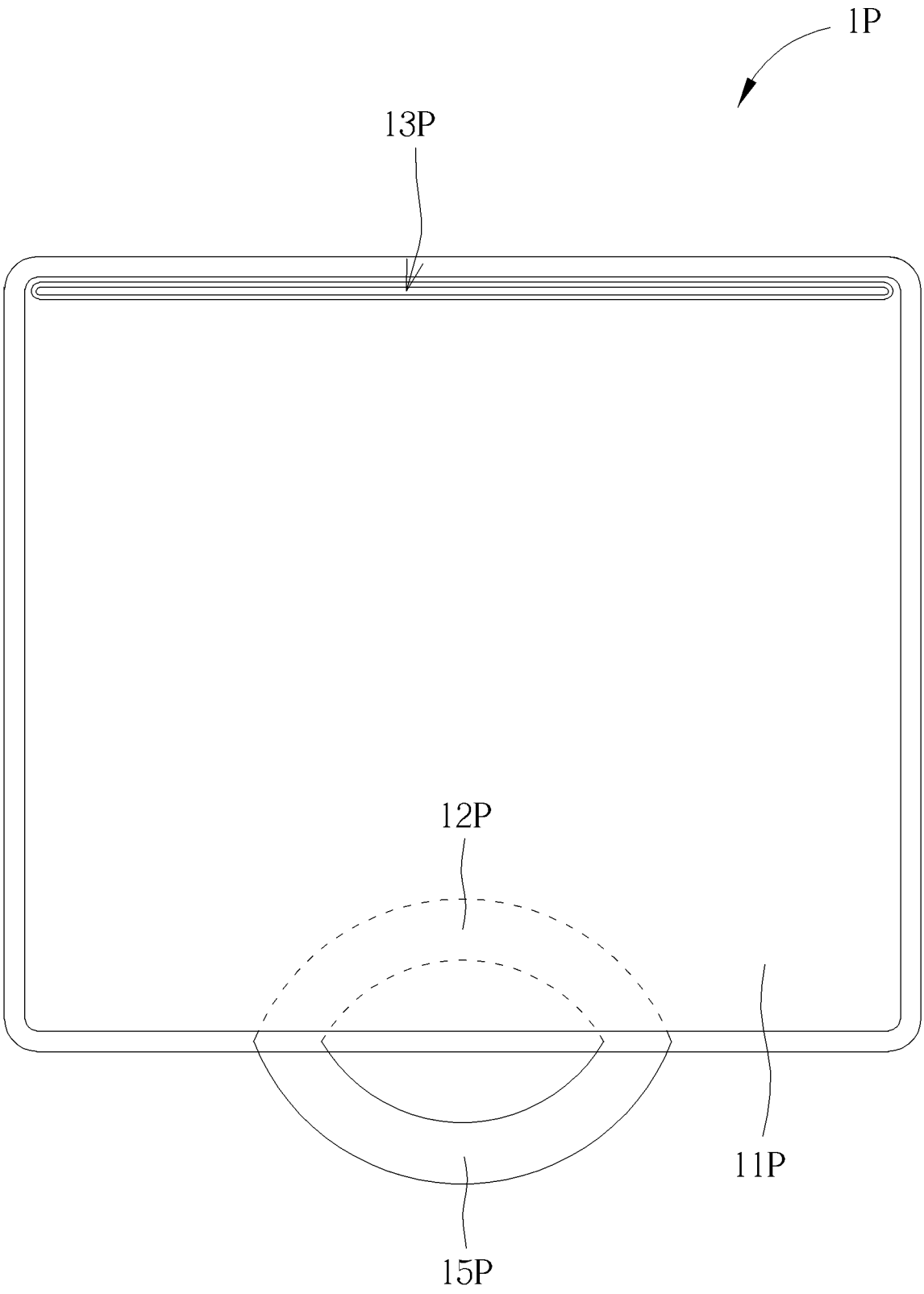

For example, please refer to FIG. 19 to FIG. 26. FIG. 19 to FIG. 26 are diagrams of storage bags 1M-1P according to different embodiments of the present invention. As shown in FIG. 19 to FIG. 26, the storage bags 1M-1P include bag bodies 11M-11P, first operating components 12M-12P, sealing systems 13M-13P, and second operating components 15M-15P. The bag body 11M-11P, the first operating components 12M-12P and sealing systems 13M-13P are respectively similar to the ones of the storage bags 1A-1D of the first embodiment to the fourth embodiment. Detailed description is omitted herein for simplicity. The second operating components 15M-15P are connected to outer sides of bottom portions of the bag bodies 11M-11P opposite to inner sides of the bottom portions of the bag bodies 11M-11P. As shown in FIG. 19 and FIG. 20, the first operating component 12M and the second operating component 15M have identical structure, and the first operating component 12M and the second operating component 15M are separated from each other and connected to two opposite sides of a bottom layer of the bag body 11M. As shown in FIG. 21 and FIG. 22, the first operating component 12N and the second operating component 15N have identical structure, and the first operating component 12N and the second operating component 15N are separated from each other and connected to two opposite sides of a bottom layer of the bag body 11N. As shown in FIG. 23 and FIG. 24, the first operating component 12O and the second operating component 15O have identical structure, and the first operating component 12O and the second operating component 15O are connected to each other. Furthermore, a connection of the first operating component 12O and the second operating component 15O is connected to and located between a bottom portion of a first layer of the bag body 11O and a bottom portion of a second layer of the bag body 11O, and an operating portion of the first operating component 12O and an operating portion of the second operating component 15O are respectively located inside and outside of the bag body 11O. As shown in FIG. 25 and FIG. 26, the first operating component 12P and the second operating component 15P have identical structure, and the first operating component 12P and the second operating component 15P are connected to each other. Furthermore, a connection of the first operating component 12P and the second operating component 15P is connected to and located between a bottom portion of a first layer of the bag body 11P and a bottom portion of a second layer of the bag body 11P, and an operating portion of the first operating component 12P and an operating portion of the second operating component 15P are respectively located inside and outside of the bag body 11P. However, the present invention is not limited to the aforementioned embodiment. For example, in another embodiment, structure of the first operating component can be different from the second operating component. Understandably, in other embodiments, the storage bag can include a bag body, a first operating component, a sealing system, a second operating component, and a vacuum valve.

In contrast to the prior art, since the storage bag of the present invention includes the first operating component connected to the inner side of the bottom portion of the bag body, the present invention allows a user to flip the bag body inside out by pulling the first operating component through the opening, which makes it easy to clean the interior of the bag body thoroughly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A storage bag with easy flipping feature, the storage bag comprising:

a bag body comprising a top portion and a bottom portion opposite to the top portion, an opening being formed on the top portion, the bag body comprising a first layer, a second layer and a bottom layer, two lateral portions of the first layer being respectively connected to two lateral portions of the second layer, a bottom layer being connected to a bottom portion of the first layer and a bottom portion of the second layer, and the bottom portion of the bag body being wider than the top portion of the bag body along a wide direction; and a first operating component connected to an inner side of the bottom portion, two end portions of the first operating component being arranged along the wide direction and connected to the bottom layer, a middle portion of the first operating component between the two end portions of the first operating component being separated from the bottom layer, and an operating space being formed between the middle portion of the first operating component and the bottom layer.

2. The storage bag of claim 1, wherein a top portion of the first layer is connected to a top portion of the second layer, and the opening is formed on the top portion of the first layer.

3. The storage bag of claim 2, further comprising a sealing system for sealing the opening.

4. The storage bag of claim 2, further comprising a vacuum system for discharging a fluid inside the bag body.

5. The storage bag of claim 1, wherein the opening is formed between a top portion of the first layer and a top portion of the second layer.

6. The storage bag of claim 5, further comprising a sealing system for sealing the opening.

7. The storage bag of claim 5, further comprising a vacuum system for discharging a fluid inside the bag body.

8. The storage bag of claim 1, further comprising a second operating component connected to an outer side of the bottom portion opposite to the inner side of the bottom portion.

9. A storage bag with easy flipping feature, the storage bag comprising:

a bag body comprising a top portion and a bottom portion opposite to the top portion, the bag body comprising a first layer and a second layer, two lateral portions of the first layer being respectively directly connected to two lateral portions of the second layer, a bottom portion of the first layer being directly connected to a bottom portion of the second layer, a top portion of the first layer being connected to a top portion of the second layer, and an opening being formed on the top portion of the first layer; and a first operating component connected to an inner side of the bottom portion, and a portion of the first operating component being located between and connected to the bottom portion of the first layer and the bottom portion of the second layer.

10. The storage bag of claim 9, wherein an operating space is formed on an operating end of the first operating component away from a connecting end of the first operating component connected to the bottom portion of the first layer and the bottom portion of the second layer.

11. The storage bag of claim 9, wherein two end portions of the first operating component are arranged along a longitudinal direction and connected to the bottom portion of the first layer and the bottom portion of the second layer, a middle portion of the first operating component between the two end portions of the first operating component is separated from the bottom portion of the first layer and the bottom portion of the second layer, and an operating space is formed between the middle portion of the first operating component and the bottom portion of the bag body.

12. The storage bag of claim 9, further comprising a sealing system for sealing the opening.

13. The storage bag of claim 9, further comprising a vacuum system for discharging a fluid inside the bag body.

14. The storage bag of claim 9, further comprising a second operating component connected to an outer side of the bottom portion opposite to the inner side of the bottom portion.

15. A storage bag with easy flipping feature, the storage bag comprising:

a bag body comprising a top portion and a bottom portion opposite to the top portion, an opening being formed on the top portion, the bag body comprising a first layer, a second layer and a bottom layer, two lateral portions of the first layer being respectively connected to two lateral portions of the second layer, a bottom layer being connected to a bottom portion of the first layer and a bottom portion of the second layer, and the bottom portion of the bag body being wider than the top portion of the bag body along a wide direction; and a first operating component connected to an inner side of the bottom portion, two end portions of the first operating component being arranged along a longitudinal direction perpendicular to the wide direction and connected to the bottom layer, a middle portion of the first operating component between the two end portions of the first operating component being separated from the bottom layer, and an operating space being formed between the middle portion of the first operating component and the bottom layer.

16. The storage bag of claim 15, wherein a top portion of the first layer is connected to a top portion of the second layer, and the opening is formed on the top portion of the first layer.

17. The storage bag of claim 16, further comprising a sealing system for sealing the opening.

18. The storage bag of claim 16, further comprising a vacuum system for discharging a fluid inside the bag body.

19. The storage bag of claim 15, wherein the opening is formed between a top portion of the first layer and a top portion of the second layer.

20. The storage bag of claim 19, further comprising a sealing system for sealing the opening.

21. The storage bag of claim 19, further comprising a vacuum system for discharging a fluid inside the bag body.

22. The storage bag of claim 15, further comprising a second operating component connected to an outer side of the bottom portion opposite to the inner side of the bottom portion.

23. A storage bag with easy flipping feature, the storage bag comprising:

a bag body comprising a top portion and a bottom portion opposite to the top portion, the bag body comprising a first layer and a second layer, two lateral portions of the first layer being respectively directly connected to two lateral portions of the second layer, a bottom portion of the first layer being directly connected to a bottom portion of the second layer, an opening being formed between a top portion of the first layer and a top portion of the second layer;

a first operating component connected to an inner side of the bottom portion, and a portion of the first operating component being located between and connected to the bottom portion of the first layer and the bottom portion of the second layer; and a vacuum system for discharging a fluid inside the bag body.

24. The storage bag of claim 23, further comprising a sealing system for sealing the opening.

25. The storage bag of claim 23, wherein an operating space is formed on an operating end of the first operating component away from a connecting end of the first operating component connected to the bottom portion of the first layer and the bottom portion of the second layer.

26. The storage bag of claim 23, wherein two end portions of the first operating component are arranged along a longitudinal direction and connected to the bottom portion of the first layer and the bottom portion of the second layer, a middle portion of the first operating component between the two end portions of the first operating component is separated from the bottom portion of the first layer and the bottom portion of the second layer, and an operating space is formed between the middle portion of the first operating component and the bottom portion of the bag body.

27. The storage bag of claim 23, further comprising a second operating component connected to an outer side of the bottom portion opposite to the inner side of the bottom portion.

* * * * *